US008864129B2

(12) United States Patent
Fukuda

(10) Patent No.: US 8,864,129 B2
(45) Date of Patent: Oct. 21, 2014

(54) SHEET PROCESSING APPARATUS, METHOD OF CONTROLLING THE SAME, AND STORAGE MEDIUM STORING PROGRAM

(71) Applicant: Canon Kabushiki Kaisha, Tokyo (JP)

(72) Inventor: Shin Fukuda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/065,659

(22) Filed: Oct. 29, 2013

(65) Prior Publication Data

US 2014/0131940 A1 May 15, 2014

(30) Foreign Application Priority Data

Nov. 9, 2012 (JP) ..... 2012-247748

(51) Int. Cl.
*B65H 31/20* (2006.01)
*B65H 31/34* (2006.01)

(52) U.S. Cl.
CPC ..... *B65H 31/34* (2013.01); *B65H 31/20* (2013.01)
USPC ..... 271/176; 271/220; 271/223

(58) Field of Classification Search
CPC .. B65H 31/20; B65H 31/34; B65H 2301/421; B65H 2301/4212; B65H 2301/4219
USPC ..... 271/176, 207, 220, 223
See application file for complete search history.

(56) References Cited

U.S. PATENT DOCUMENTS

| | | | | |
|---|---|---|---|---|
| 8,136,807 | B2 * | 3/2012 | Uchiyama et al. | 270/58.27 |
| 2005/0189706 | A1 * | 9/2005 | Tamura et al. | 271/221 |
| 2007/0108697 | A1 * | 5/2007 | Tamura et al. | 271/220 |
| 2012/0025442 | A1 * | 2/2012 | Naraoka | 270/58.12 |
| 2012/0049441 | A1 * | 3/2012 | Kimura et al. | 271/177 |
| 2012/0299239 | A1 * | 11/2012 | Wang et al. | 271/227 |
| 2013/0026703 | A1 * | 1/2013 | Watanabe et al. | 271/220 |
| 2013/0032988 | A1 * | 2/2013 | Miyake et al. | 270/58.08 |
| 2013/0032991 | A1 * | 2/2013 | Ando et al. | 271/220 |

FOREIGN PATENT DOCUMENTS

JP 2006-206331 A 8/2006

OTHER PUBLICATIONS

This application is related U.S. Appl. No. 14/065,920.

* cited by examiner

*Primary Examiner* — David H Bollinger
(74) *Attorney, Agent, or Firm* — Cowan, Liebowitz & Latman, P.C.

(57) ABSTRACT

When a second sheet that is different from a first sheet discharged and stacked on a stacking unit is to be stacked on the first sheet, whether or not to apply an alignment process to the second sheet is determined. If it is determined that the alignment process is not to be applied to the second sheet, the second sheet is stacked on the stacking unit. The alignment process is not applied thereto. If it is determined that the alignment process is to be applied to the second sheet, the second sheet is stacked on the stacking unit and the alignment process is applied thereto.

10 Claims, 22 Drawing Sheets

ALIGNING POSITION

RETRACTED POSITION

POSITIONS OF ALIGNMENT PLATES WHEN ALIGNMENT IS FINISHED

POSITIONS OF ALIGNMENT PLATES THAT HAVE BEEN RAISED OFF TRAY

POSITIONS OF ALIGNMENT PLATES FOR ACCEPTING NEXT SHEET

POSITIONS OF ALIGNMENT PLATES COMING INTO CONTACT WITH ALREADY-STACKED SHEETS

POSITIONS OF ALIGNMENT PLATES WHEN SHEET IS DISCHARGED

POSITIONS OF ALIGNMENT PLATES WHEN EXECUTING ALIGNMENT

ALIGNMENT WAITING POSITIONS OF ALIGNMENT PLATES

FIG. 10A FINISHING SELECTION SCREEN
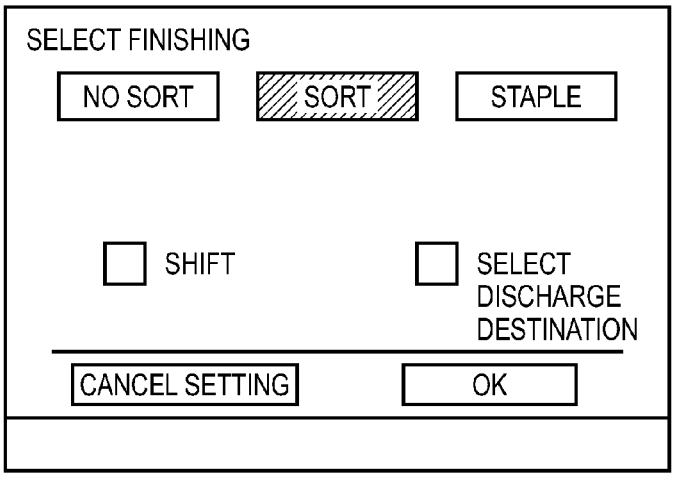
FIG. 10B FINISHING SELECTION SCREEN
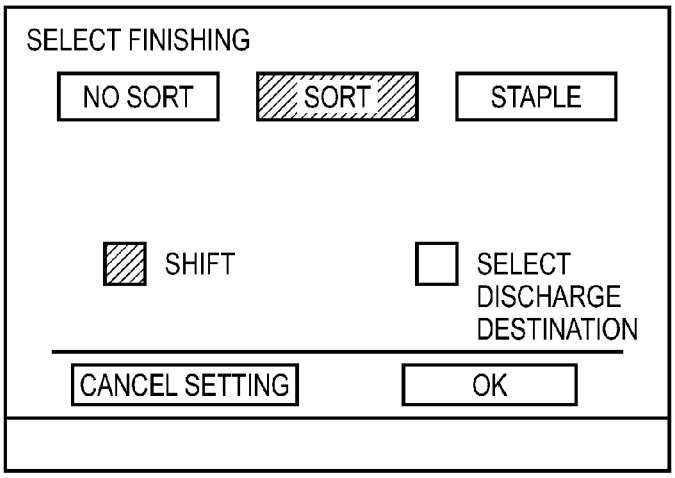
FIG. 10C DISCHARGE DESTINATION SELECTION SCREEN
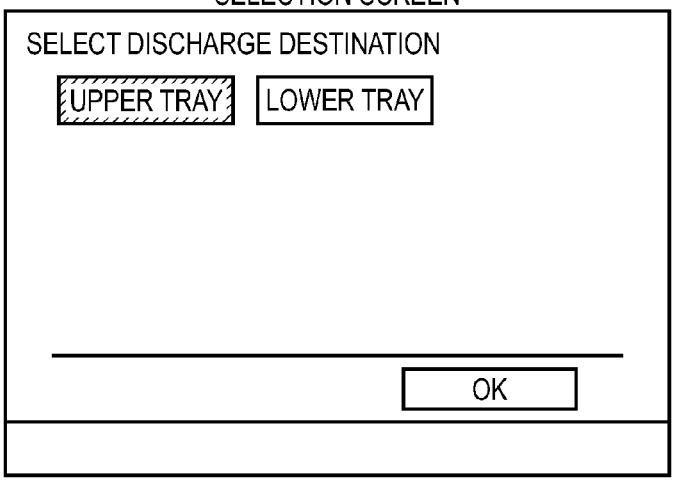

APPLIED MODE SELECTION SCREEN

SIZE-MIXED STACK SCREEN

SIZE-MIXED STACK SCREEN

SHEET PROCESSING APPARATUS, METHOD OF CONTROLLING THE SAME, AND STORAGE MEDIUM STORING PROGRAM

BACKGROUND OF THE INVENTION

1. Field of the Invention

The present invention relates to a sheet processing apparatus that has a function of aligning sheets stacked on a tray, a control method for the sheet processing apparatus, and a storage medium storing a program.

2. Description of the Related Art

For sheet stackers that stack printed sheets discharged from a printing apparatus on a tray, there has been demand for the ability to align the sheets on the tray with a high degree of accuracy. Japanese Patent Laid-Open No. 2006-206331 suggests a technique to align sheets stacked on a stack tray. According to this technique, alignment members are provided on the stack tray, and the positions of edge surfaces of the sheets parallel to a sheet discharge direction are aligned by the alignment members coming into and out of contact with the edge surfaces of the sheets.

Now, assume the case where, as shown in FIG. 20, sheets having a sheet width W2 are to be stacked and aligned on sheets that have a different sheet width W1 and are already stacked on a stack tray 2001 (W2<W1). In this case, in order to align the sheets having the sheet width W2, it is necessary to cause alignment plates A and B to come into contact with a top surface of the already-stacked sheets. When sheet alignment operations are executed by moving the alignment plate A in the direction of an arrow shown in FIG. 20 while the alignment plates A and B are thus in contact with the top surface of the already-stacked sheets, the bottom surface of the alignment plate A is slid against the front surface of the top sheet of the already-stacked sheets. This can lead to the possibility that the toner printed on the topmost sheet of the already-stacked sheets is removed and the quality of an image on the topmost sheet is degraded.

There is also the possibility that the removed toner is attached to and stains the bottom surface of the alignment plate A, and the attached toner stains other sheets when the bottom surface of the alignment plate A comes into contact with other sheets. Upon printing sheets that have a different width from sheets that are already printed and stacked, the printing may be interrupted first to allow a user to remove the sheets that are already printed and stacked from the stack tray, and then the printing may be resumed for the sheets that have a different width. Although this method does not give rise to the aforementioned problem, it is still problematic in that it reduces the productivity of printing.

SUMMARY OF THE INVENTION

An aspect of the present invention is to eliminate the above-mentioned problems with the conventional technology.

The present invention provides a technique to prevent reduction in the alignment quality for already-stacked sheets by interrupting printing if it is determined that the alignment quality will be reduced, and to continue a discharge process without interrupting printing if it is determined that the alignment quality will not be reduced.

The present invention in one aspect provides a sheet processing apparatus comprising: a stacking unit configured to stack a discharged sheet; an alignment unit configured to align the sheets stacked on the stacking unit by causing a first alignment member and a second alignment member to come into contact with edges of the sheets stacked on the stacking unit; a determination unit configured to, in a case where a second sheet that is different from a first sheet stacked on the stacking unit is to be stacked on the first sheet, determine whether or not the alignment unit is to apply an alignment process to the second sheet; and a controller configured to in a case where the determination unit determines that the alignment process is not to be applied to the second sheet, perform control to stack the second sheet on the stacking unit and control the alignment unit not to apply the alignment process to the second sheet, and in a case where the determination unit determines that the alignment process is to be applied to the second sheet, perform control to stack the second sheet on the stacking unit and cause the alignment unit to apply the alignment process to the second sheet.

The present invention enables prevention of reduction in the alignment quality for already-stacked sheets by interrupting printing if it is determined that the alignment quality will be reduced, and enables continuation of a discharge process without interrupting printing if it is determined that the alignment quality will not be reduced. As a result, the usability is improved.

Further features of the present invention will become apparent from the following description of exemplary embodiments with reference to the attached drawings.

BRIEF DESCRIPTION OF THE DRAWINGS

FIGS. 10A to 10C show examples of screens displayed on the console unit in the image forming apparatus.

DESCRIPTION OF THE EMBODIMENTS

Preferred embodiments of the present invention will now be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention.

Figure 1:
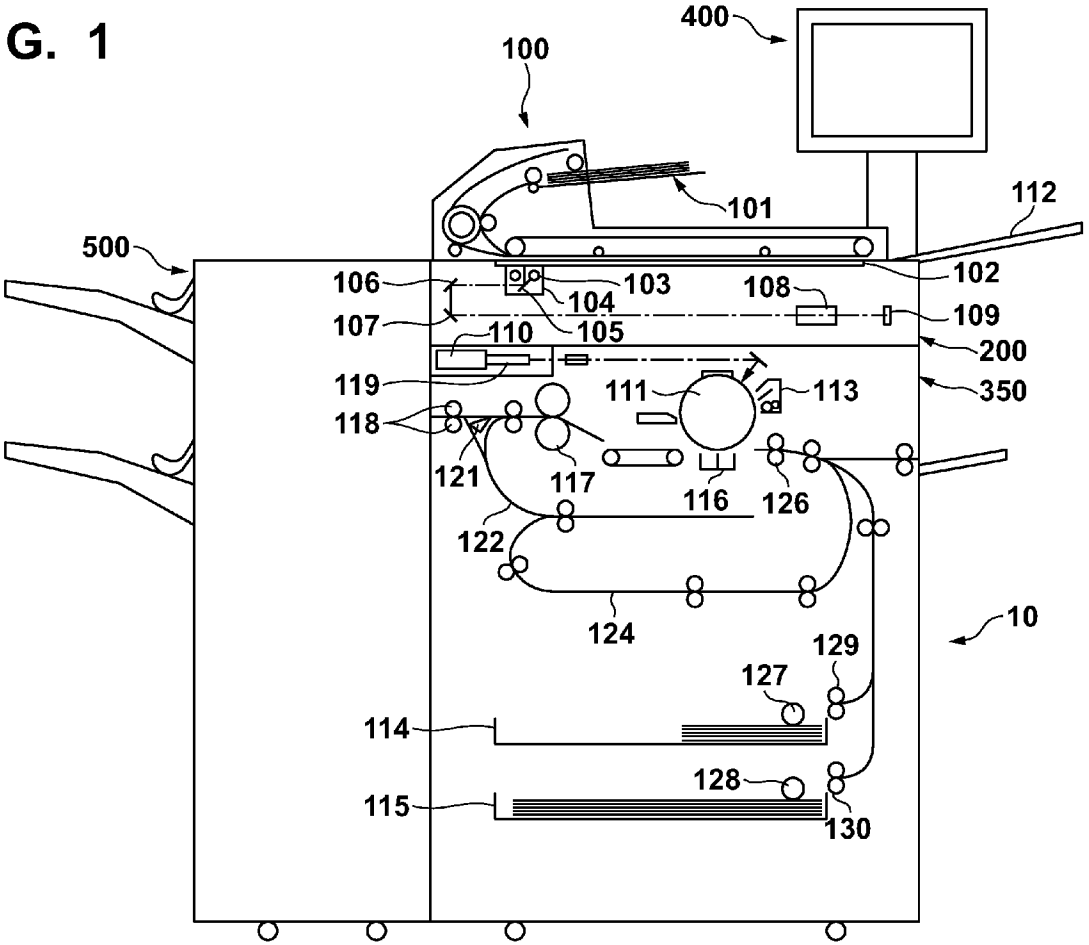
FIG. 1 is a configuration diagram showing cross-sectional configurations of main parts of an image forming system.

FIG. 1 is a configuration diagram showing cross-sectional configurations of main parts of an image forming system according to embodiments of the present invention.

This image forming system includes an image forming apparatus 10 and a finisher 500 that serves as a sheet stacker. The image forming apparatus 10 includes an image reader 200 that reads an image from an original, and a printer 350 that forms (prints) the read image on a sheet.

A document feeder 100 feeds originals set on an original tray 101 one by one in order starting from the top original, conveys the originals along a curved path and past a predetermined reading position on a glass platen 102, then discharges the originals onto a discharge tray 112. Note that the originals are set on the original tray 101 with their front sides up. At this time, a scanner unit 104 is fixed at the predetermined reading position. When an original passes the reading position, an image of the original is read by the scanner unit 104. When the original passes the reading position, the original is irradiated with light from a lamp (a light source) 103 in the scanner unit 104, and reflected light from the original is directed to a lens 108 via mirrors 105, 106 and 107. Light that has passed through this lens 108 is focused on an imaging surface of an image sensor 109, converted into image data, and output. The image data output from the image sensor 109 is input as a video signal to an exposure unit 110 in the printer 350.

The exposure unit 110 in the printer 350 outputs laser light that has been modulated based on a video signal input from the image reader 200. A photosensitive drum 111 is irradiated with and scanned by this laser light using a polygonal mirror 119. An electrostatic latent image corresponding to the laser light that has scanned the photosensitive drum 111 is formed on the photosensitive drum 111. This electrostatic latent image on the photosensitive drum 111 turns into a visible image by being developed using a developing agent fed from a developer 113.

Sheets used in the printing are picked up one by one from a sheet feeding tray 114 or 115, which is provided in the printer 350, by rotation of a pickup roller 127 or 128. The sheets thus picked up are conveyed to the position of registration rollers 126 by rotation of sheet feeding rollers 129 or 130. Although FIG. 1 shows only two sheet feeding trays for the sake of explanation, the printer 350 may include other sheet feeding trays that are not shown in the figures. Furthermore, additional sheet feeding trays may be provided by connecting an optional sheet feeding apparatus not shown in the figures to the printer 350. When the leading edge of a sheet arrives at the position of the registration rollers 126, the registration rollers 126 are driven and rotated at a predetermined timing so as to convey the sheet between the photosensitive drum 111 and a transfer unit 116. Accordingly, an image of the developing agent formed on the photosensitive drum 111 is transferred to the fed sheet by the transfer unit 116. In the following embodiments, a 1D-type image forming apparatus 10 including one developer 113 and one photosensitive drum 111 is described as an example. However, the present invention is not limited in this way, and the image forming apparatus 10 may alternatively include developers and photosensitive drums corresponding to C (cyan), M (magenta), Y (yellow) and K (black). The sheet to which the image of the developing agent has been thus transferred is conveyed to a fixing unit 117. The fixing unit 117 fixes the image on the sheet by applying heat and pressure to the sheet. The sheet that has passed the fixing unit 117 is discharged to the outside of the printer 350 (to the finisher 500) via a flapper 121 and discharge rollers 118. In the case where images are formed on both sides of the sheet, the sheet is conveyed to a double-sided conveying path 124 via a reversing path 122, then conveyed to the position of the registration rollers 126 again.

Figure 2:
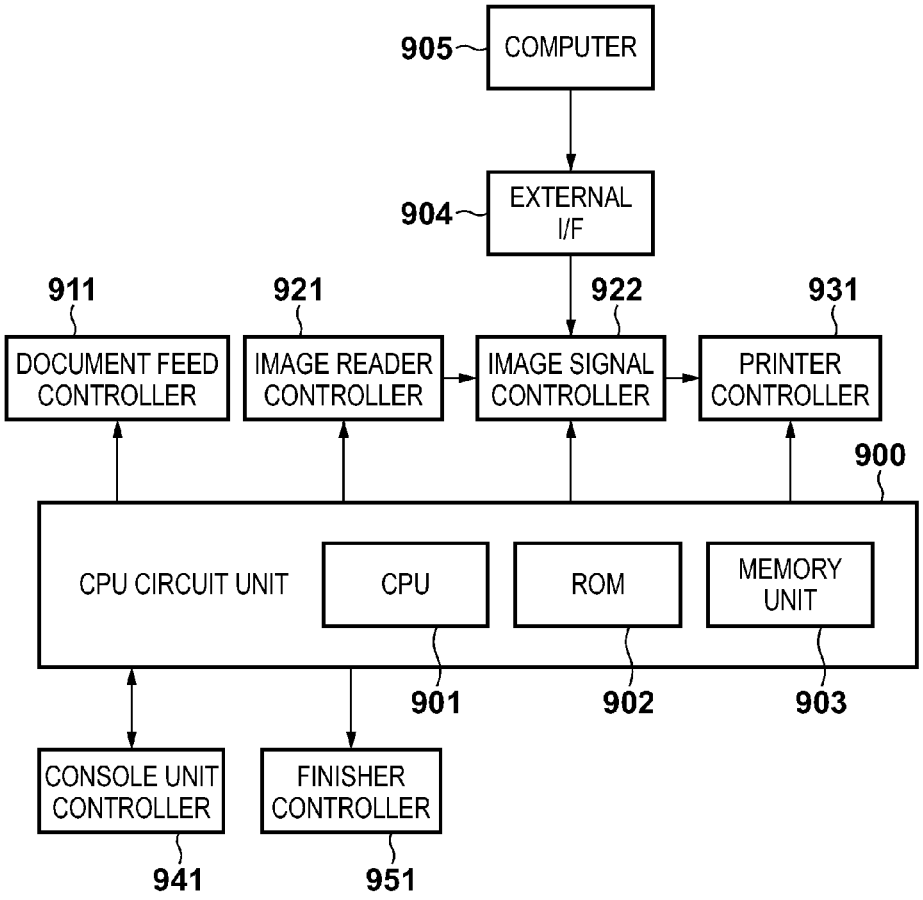
FIG. 2 is a block diagram showing a configuration of a controller that controls the entirety of the image forming system.

The following describes a configuration of a controller that controls the entirety of the image forming system and a block diagram of the entirety of the system according to some embodiments with reference to FIG. 2. FIG. 2 is a block diagram showing a configuration of a controller that controls the entirety of the image forming system according to embodiments.

The controller includes a CPU circuit unit 900, and the CPU circuit unit 900 includes a CPU 901, a ROM 902, and a memory unit 903. The memory unit 903 is constituted by a RAM or an HDD. The CPU 901 controls the entirety of the present image forming system, and is connected to the ROM 902 in which control programs are written and to the memory unit 903 for temporarily storing various types of data via an address bus and a data bus (not shown in the figures). The CPU 901 also performs overall control of controllers 911, 921, 922, 931, 941 and 951, as well as an external interface 904, in accordance with the control programs stored in the ROM 902. The memory unit 903 temporarily holds control data and is used as a working area for calculation processing associated with control.

A document feed controller 911 controls driving of the document feeder 100 based on instructions from the CPU circuit unit 900. An image reader controller 921 controls driving of the above-described scanner unit 104, image sensor 109, and the like, and transfers an image signal output from the image sensor 109 to an image signal controller 922. The image signal controller 922 converts an analog image signal from the image sensor 109 into a digital signal, applies various types of processing to the digital signal, converts the digital signal into a video signal, and outputs the video signal to a printer controller 931. The image signal controller 922 also converts a digital image signal input from a computer 905 via the external I/F 904 into a video signal by applying various types of processing to the digital image signal, and outputs the video signal to the printer controller 931. The operations of processing executed by this image signal controller 922 are controlled by the CPU circuit unit 900. The printer controller 931 controls the exposure unit 110 and the printer 350 based on the input video signal so as to form images, convey sheets, and the like. A finisher controller 951 is mounted on the finisher 500, and controls driving of the finisher 500 by exchanging information with the CPU circuit unit 900. The details of this control will be described later. A console unit controller 941 exchanges information with a console unit 400 shown in FIG. 1 and the CPU circuit unit 900. The console unit 400 includes, for example, a plurality of keys for setting various types of functions related to image formation, and a display unit for displaying information showing the states of settings. The console unit 400 outputs key signals corresponding to operations applied to the keys to the CPU circuit unit 900. Based on signals from the CPU circuit unit 900, the console unit 400 displays corresponding information.

Figure 3:
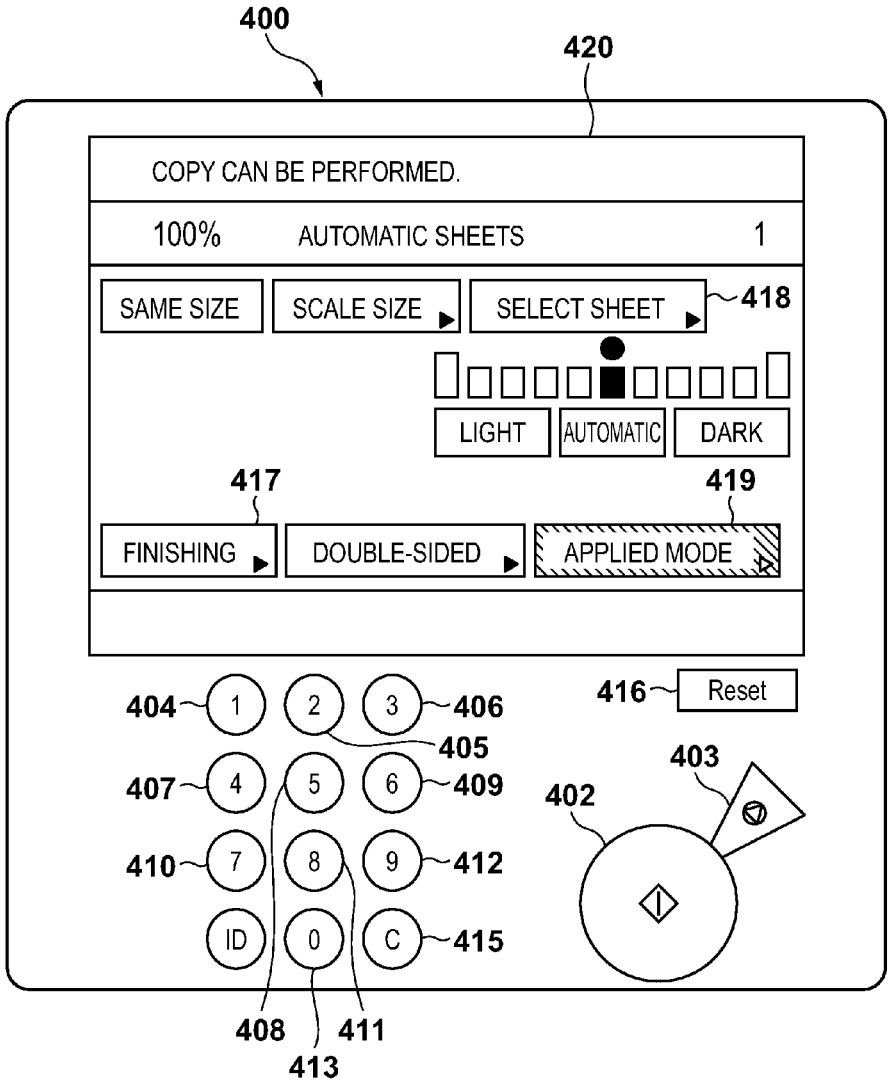
FIG. 3 is a diagram for describing a console unit in an image forming apparatus.

FIG. 3 is a diagram for describing the console unit 400 in the image forming apparatus 10 according to embodiments.

For example, a start key 402, a stop key 403, numeric keys 404 to 413, a clear key 415, and a reset key 416 are arranged on the console unit 400. The start key 402 is used to start the image forming operations. The stop key 403 is used to interrupt the image forming operations. The numeric keys 404 to 413 are used to, for example, enter numbers. A display unit 420 is also arranged on the console unit 400. A touchscreen is formed on the upper part of the display unit 420. Software keys can be generated on a screen of the display unit 420.

This image forming apparatus 10 has various process modes as post-process modes, including no sort, sort, shift-sort, staple-sort (bind mode), and the like. The settings and the like for these process modes are input from the console unit 400. For example, a post-process mode is set as follows. If a "Finishing" software key 417 is selected on a default screen shown in FIG. 3, a menu selection screen is displayed on the display unit 420. On this menu selection screen, a process mode is set.

Figure 4B:
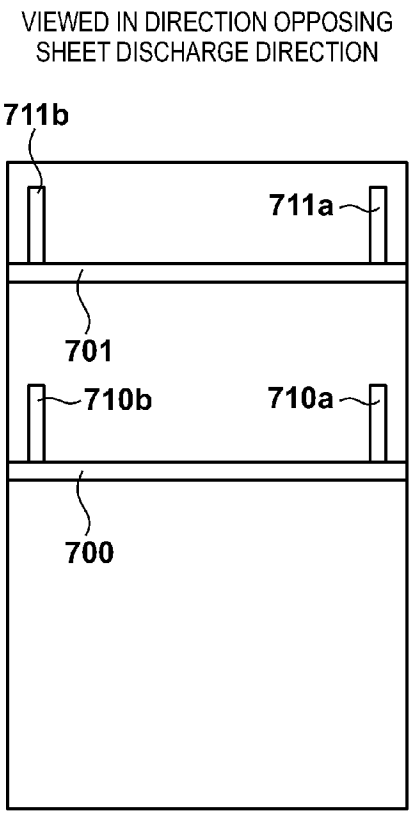
FIGS. 4A and 4B are diagrams for describing a configuration of a finisher.
Figure 4A:
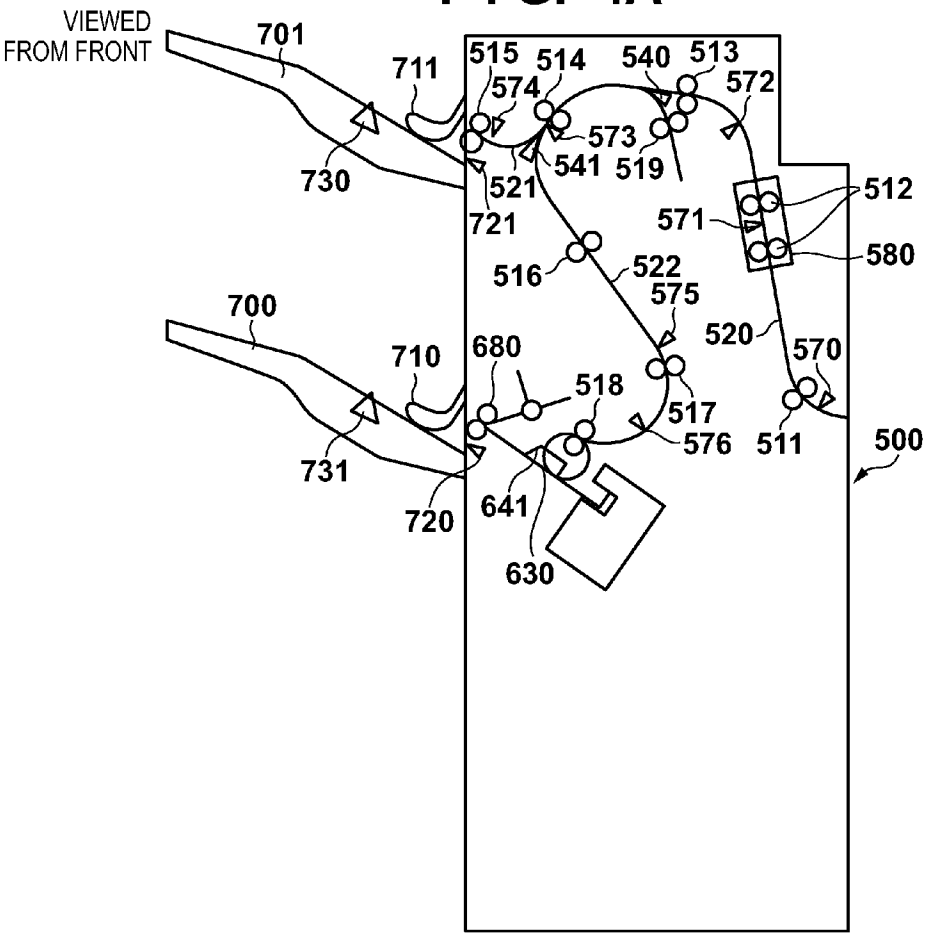

The following describes a configuration of the finisher 500 with reference to FIGS. 4A and 4B. FIGS. 4A and 4B are diagrams for describing a configuration of the finisher 500 according to embodiments. FIG. 4A shows the finisher 500 as viewed from the front, and FIG. 4B shows stack trays 700 and 701 in the finisher 500 as viewed in a direction opposing a sheet discharge direction.

First, a description is provided with reference to FIG. 4A.

The finisher 500 receives sheets discharged from the image forming apparatus 10 in order, and executes post-processes such as a process for aligning the plurality of received sheets in a bundle, and a staple process for binding the trailing edges of the bundle of sheets using a stapler. The finisher 500 receives a sheet discharged from the image forming apparatus 10 along a conveyance path 520 using a pair of conveyance rollers 511. The sheet that has been received using the pair of conveyance rollers 511 is conveyed via pairs of conveyance rollers 512, 513 and 514. Conveyance sensors 570, 571, 572 and 573 are provided on the conveyance path 520 to detect passing of the sheet. The pair of conveyance rollers 512 is provided in a shift unit 580 together with the conveyance sensor 571.

Figure 5:
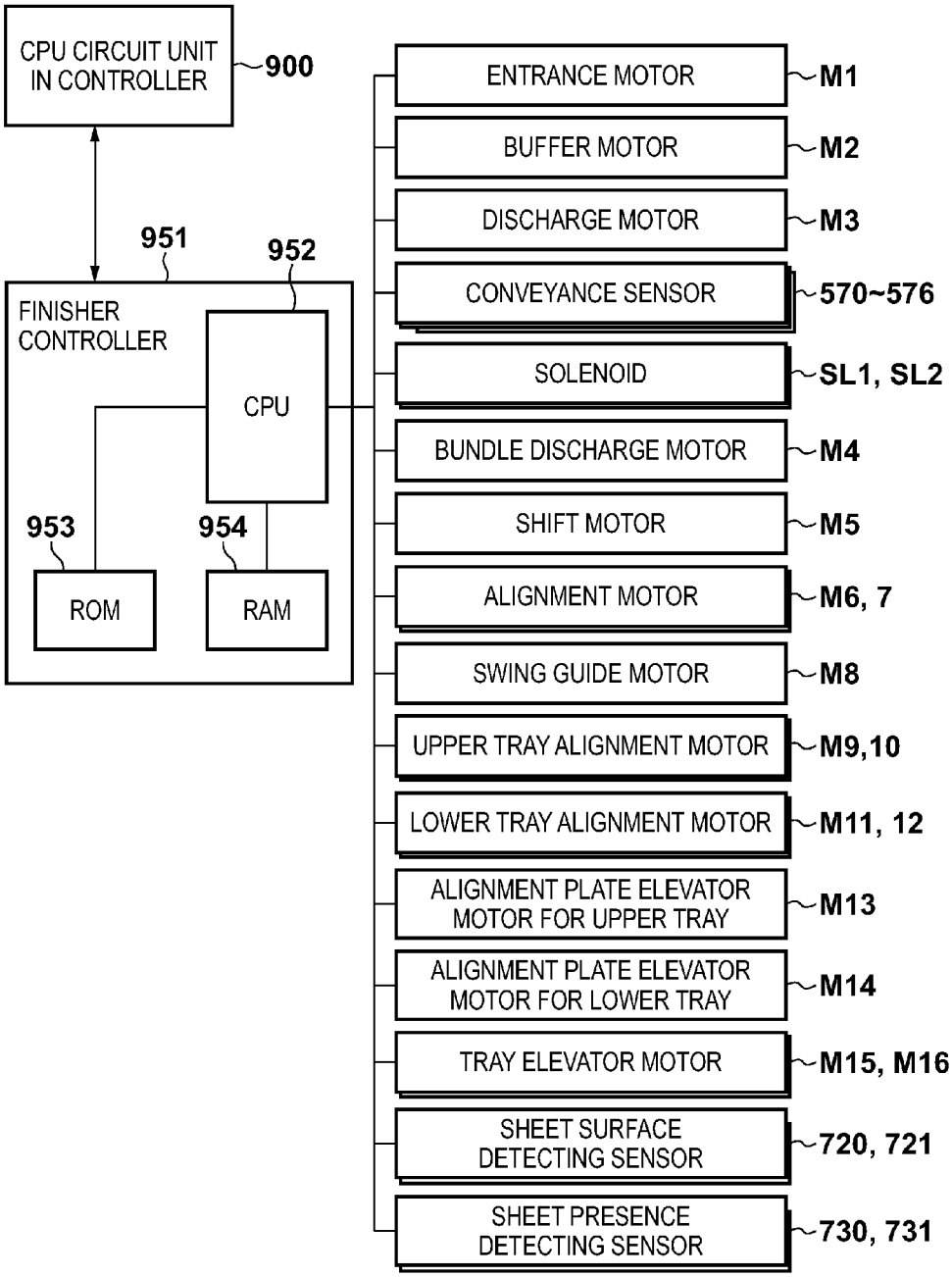
FIG. 5 is a block diagram showing a configuration of a finisher controller.

The shift unit 580 can move the sheet in a sheet width direction orthogonal to a sheet conveyance direction using a later-described shift motor M5 (FIG. 5). By driving the shift motor M5 while the pair of conveyance rollers 512 is holding the sheet therebetween, the sheet can be offset in the width direction while being conveyed. In a shift-sort mode, the position of a bundle of sheets is moved in the width direction on a per-copy basis. For example, an offset amount of 15 mm toward the front (front shift), or an offset amount of 15 mm toward the back (back shift), is set with respect to the center position in the width direction. When no designation is made regarding the shift, sheets are discharged at the same position as in the front shift.

When the finisher 500 detects that a sheet has passed the shift unit 580 based on the input from the conveyance sensor 571, the finisher 500 drives the shift motor M5 (FIG. 5) to place the shift unit 580 back to the center position. A switching flapper 540, which directs a sheet conveyed in a reverse fashion by the pair of conveyance rollers 514 to a buffer path 523, is arranged between the pair of conveyance rollers 513 and the pair of conveyance rollers 514. The switching flapper 540 is driven by a later-described solenoid SL1 (FIG. 5).

A switching flapper 541, which switches between an upper discharge path 521 and a lower discharge path 522, is arranged between the pair of conveyance rollers 514 and the pair of conveyance rollers 515. The switching flapper 541 is driven by the later-described solenoid SL1. When the switching flapper 541 switches to the upper discharge path 521, a sheet is directed to the upper discharge path 521 by the pair of conveyance rollers 514 that is driven and rotated by a buffer motor M2 (FIG. 5). Then, the sheet is discharged onto the stack tray 701 by the pair of conveyance rollers 515 that is driven and rotated by a discharge motor M3 (FIG. 5). A conveyance sensor 574 is provided on the upper discharge path 521 to detect passing of the sheet. When the switching flapper 541 switches to the lower discharge path 522, the sheet is directed to the lower discharge path 522 by the pair of conveyance rollers 514 that is driven and rotated by the buffer motor M2. This sheet is further directed to a process tray 630 by pairs of conveyance rollers 516 to 518 that are driven and rotated by the discharge motor M3. Conveyance sensors 575 and 576 are provided on the lower discharge path 522 to detect passing of the sheet. The sheet that has been directed to the process tray 630 is discharged onto the process tray 630 or the stack tray 700, in accordance with a post-process mode, by a pair of bundle discharge rollers 680 driven and rotated by a bundle discharge motor M4 (FIG. 5).

Figure 6A:
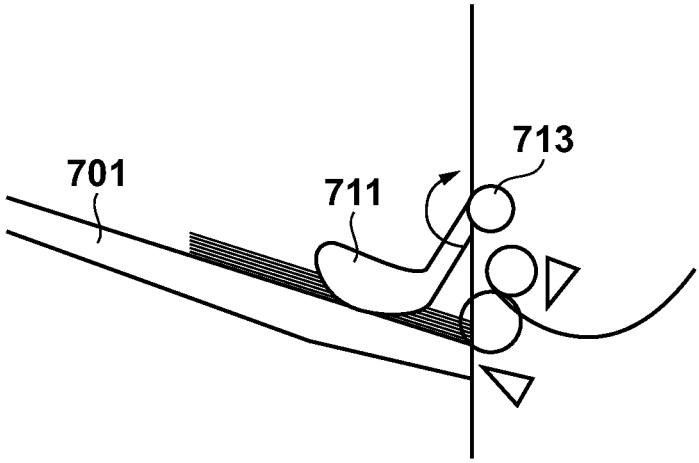
FIGS. 6A and 6B show a positional relationship between a tray and alignment plates.
Figure 6B:
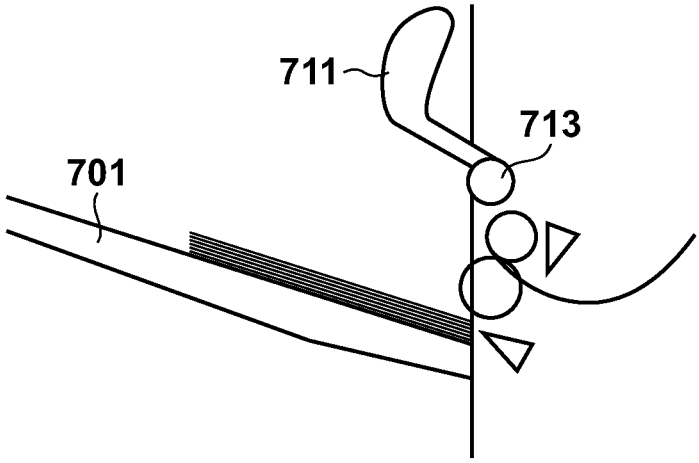

Furthermore, an alignment plate 711*a* (first alignment member) and an alignment plate 711*b* (second alignment member) are arranged on the stack tray 701 as shown in FIG. 4B. The alignment plates 711*a* and 711*b* are alignment members for aligning sheets discharged onto the stack tray 701 in the sheet width direction by coming into contact with both side edges (side ends) of the sheets. These alignment plates 711*a* and 711*b* are represented by a reference sign 711 in FIG. 4A. Similarly, alignment plates 710*a* and 710*b* are arranged on the stack tray 700. The alignment plates 710*a* and 710*b* are used to align sheets discharged onto the stack tray 700 in the sheet width direction. The alignment plates 710*a* and 710*b*, which are represented by a reference sign 710 in FIG. 4A, can be moved in the sheet width direction respectively by later-described lower tray alignment motors M11 and M12 (FIG. 5). In FIG. 4A, the alignment plates 710*a* and 710*b* are arranged respectively in the front and the back. On the other hand, the alignment plates 711*a* and 711*b* are similarly driven respectively by later-described upper tray alignment motors M9 and M10 (FIG. 5). In FIG. 4A, the alignment plates 711*a* and 711*b* are arranged respectively in the front and the back. Furthermore, the alignment plates 710 and 711 are moved up and down respectively by an alignment plate elevator motor M13 for an upper tray (FIG. 5) and an alignment plate elevator motor M14 for a lower tray (FIG. 5), which will be described later. More specifically, the alignment plates 710 and 711 are moved up and down about an alignment plate axis 713 between aligning positions where they actually execute an alignment process (FIG. 6A) and waiting positions where they wait (FIG. 6B).

The stack trays 700 and 701 can be raised and lowered by later-described tray elevator motors M15 and M16 (FIG. 5). The topmost surface of a tray or sheets on a tray is detected by later-described sheet surface detecting sensors 720 and 721 (FIG. 4A). The finisher 500 performs control so that this topmost surface of a tray or sheets on a tray is always located at a certain position by driving and rotating the tray elevator motors M15 and M16 in accordance with the input from the sheet surface detecting sensors 720 and 721. Furthermore, sheet presence detecting sensors 730 and 731 (FIG. 4A) detect whether or not there is any sheet on the stack trays 701 and 700.

A description is now given of a configuration of the finisher controller 951 that controls driving of the finisher 500 with reference to FIG. 5. FIG. 5 is a block diagram showing a configuration of the finisher controller 951 according to embodiments.

The finisher controller 951 includes a CPU 952, a ROM 953, a RAM 954, and the like. The finisher controller 951 controls driving of the finisher 500 by communicating with the CPU circuit unit 900, exchanging data with the CPU circuit unit 900, and executing various types of programs stored in the ROM 953. The data exchange denotes, for example, transmission/reception of commands, exchange of job information, and notification of sheet transfer. The following describes various types of inputs and outputs of the finisher 500.

In order to convey sheets, the finisher 500 includes an entrance motor M1 that drives and rotates the pairs of conveyance rollers 511 to 513, a buffer motor M2, a discharge motor M3, a shift motor M5, solenoids SL1 and SL2, and conveyance sensors 570 to 576. The finisher 500 also includes, as means to drive various types of members in the process tray 630 (FIG. 4A), a bundle discharge motor M4 that drives the pair of bundle discharge rollers 680, and alignment motors M6 and M7 that drive alignment members 641 (FIG. 4A). The finisher 500 further includes a swing guide motor M8 that drives a swing guide to be raised and lowered. The finisher 500 further includes tray elevator motors M15 and M16 for raising and lowering the stack trays 700 and 701, sheet surface detection sensors 720 and 721 (FIG. 4A), and sheet presence detecting sensors 730 and 731. In relation to alignment operations for sheets on the stack trays, the finisher 500 further includes upper tray alignment motors M9 and M10, lower tray alignment motors M11 and M12, an alignment plate elevator motor M13 for the upper tray, and an alignment plate elevator motor M14 for the lower tray.

Figure 11:
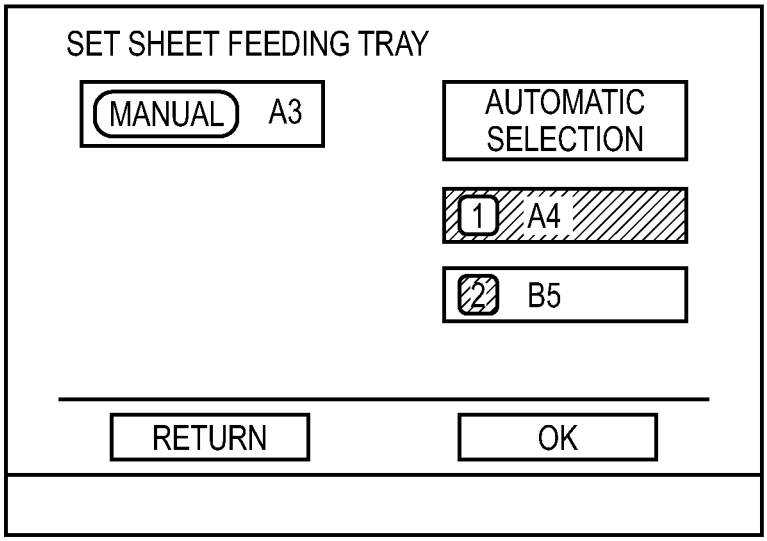
FIG. 11 shows an example of a sheet feeding tray selection screen.

The following describes a flow of sheets during a sort mode with reference to FIGS. 3, 7, 8A to 8D, 10A to 10C, and 11. If the user presses a "Select Sheet" key 418 on the default screen shown in FIG. 3 on the console unit 400 of the image forming apparatus 10, a sheet feeding tray selection screen shown in FIG. 11 is displayed on the display unit 420. On this sheet feeding tray selection screen, the user selects sheets that are to be used for a job. It is assumed here that the user selects the size "A4" corresponding to a sheet feeding tray 1. FIG. 11 shows one example of the sheet feeding tray selection screen on which a sheet feeding tray corresponding to the size "A4" is selected.

If the user selects the "Finishing" software key 417 on the default screen shown in FIG. 3 on the console unit 400 of the image forming apparatus 10, a finishing menu selection screen shown in FIG. 10A is displayed on the display unit 420. If the user presses an OK button while a "Sort" key is selected on the finishing menu selection screen shown in FIG. 10A, the sort mode is set.

In order to offset a bundle of sheets on a per-copy basis, the user presses the OK button while a "Shift" key is selected on the finishing menu selection screen shown in FIG. 10A; as a result, a shift mode is set (FIG. 10B).

Once the user has designated the sort mode and entered a job, the CPU 901 in the CPU circuit unit 900 notifies the CPU 952 in the finisher controller 951 of information related to that job, such as the sheet size and the selection of the sort mode. According to some embodiments, after sheets have been discharged in one print job, shift operations are applied to sheets printed in the next print job so that the sheets printed in the next print job are discharged at a different position from the sheets discharged in the preceding job. Such shift operations applied for each print job are referred to as an inter-job shift.

Figure 7:
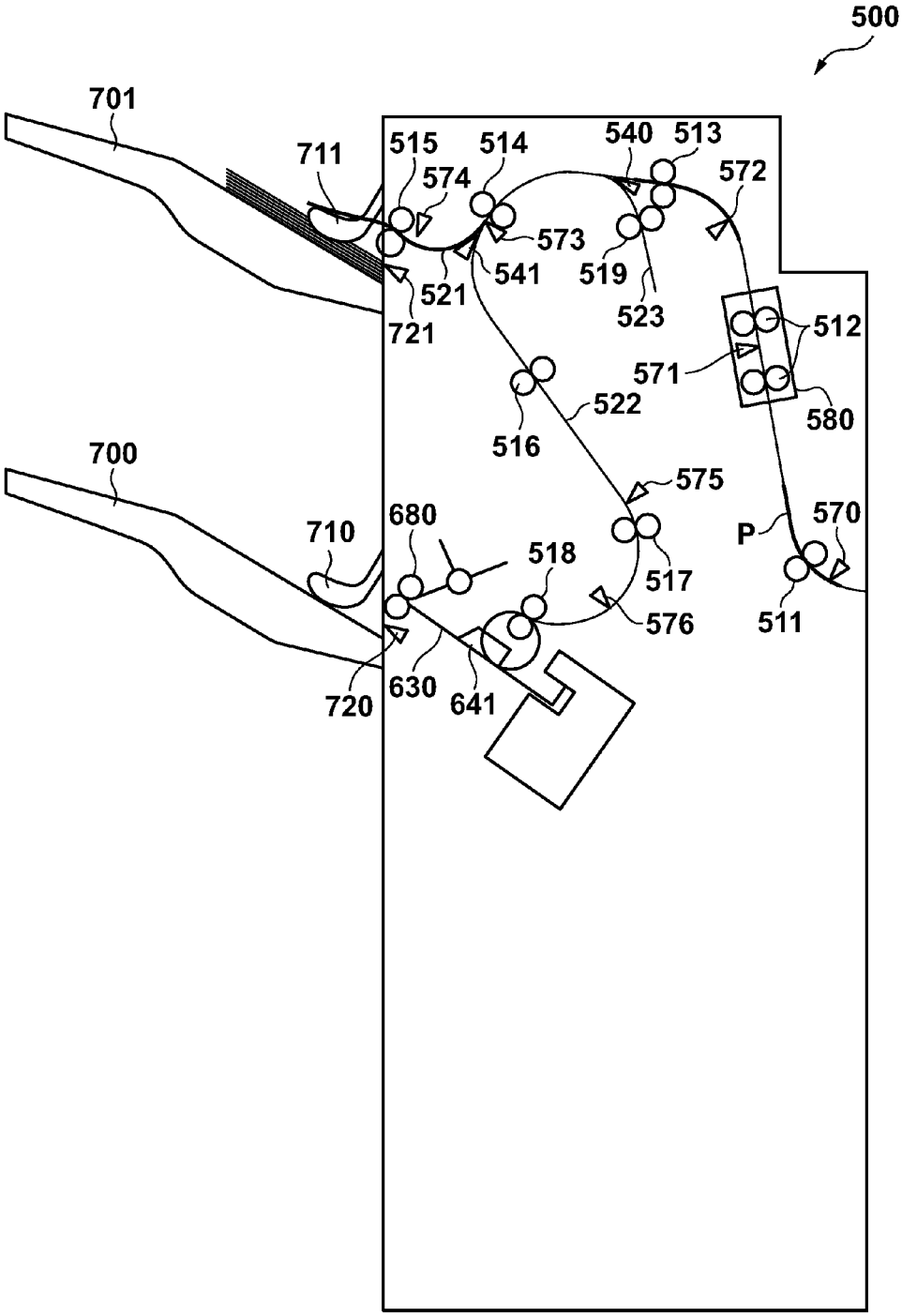
FIG. 7 is a diagram for describing the conveyance of sheets in the finisher.

FIG. 7 is a diagram for describing the conveyance of sheets in the finisher according to embodiments. In FIG. 7, the parts that are shown in the above-described FIG. 4A are given the same reference signs thereas.

When the image forming apparatus 10 discharges a sheet P to the finisher 500, the CPU 901 in the CPU circuit unit 900 notifies the CPU 952 in the finisher controller 951 of the start of sheet transfer. The CPU 901 also notifies the CPU 952 in the finisher controller 951 of sheet information, such as shift information and sheet width information of the sheet P. It is assumed here that the sheet width information is stored in the ROM 902 or the memory unit 903 in advance for each sheet size. For example, an A4-sized sheet has a width of 297 mm, an A4R-sized sheet has a width of 210 mm, and a B5-sized sheet has a width of 257 mm. A letter-sized sheet has a width of 279.4 mm. An A3-sized sheet can only be conveyed with the short edge thereof serving as the leading edge, and therefore has a width of 297 mm. Upon receiving the notification of the start of sheet transfer, the CPU 952 drives and rotates the entrance motor M1, the buffer motor M2 and the discharge motor M3. As a result, the pairs of conveyance rollers 511, 512, 513, 514 and 515 shown in FIG. 7 are driven and rotated, thus making the finisher 500 receive and transfer the sheet P discharged from the image forming apparatus 10. The conveyance path sensor 571 detects the sheet P when the pair of conveyance rollers 512 holds the sheet P therebetween. Accordingly, the CPU 952 offsets the sheet P in the width direction by moving the shift unit 580 through driving of the shift motor M5. When the shift information included in the sheet information notified from the CPU 901 shows "no shift designation", sheets are equally offset by 15 mm toward the front.

When the switching flapper 541 is driven and rotated by the solenoid S1 to be situated in the position shown in FIG. 7, the sheet P is directed to the upper discharge path 521. Then, when the conveyance sensor 574 detects passing of the trailing edge of the sheet P, the CPU 952 discharges the sheet P onto the stack tray 701 by driving and rotating the discharge motor M3 so that the sheet P is conveyed by the pair of conveyance rollers 515 at a speed suited for stacking.

Next, a description is given of the alignment operations during a sort mode, using an example of the front shift operations, with reference to FIGS. 8A to 8D. FIGS. 8A to 8D are diagrams for describing the positions of the alignment plates 711*a* and 711*b* on the stack tray 701 as viewed in a direction opposing the sheet discharge direction.

Figure 8A:
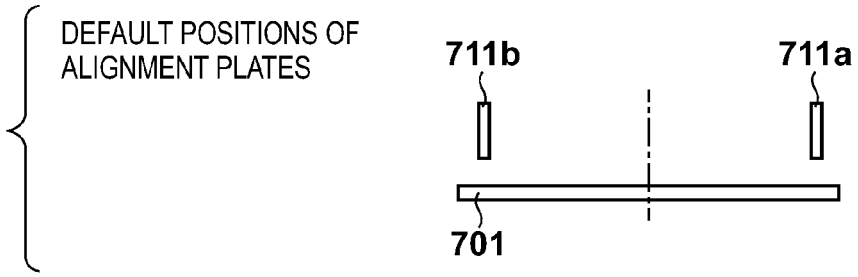
FIGS. 8A to 8D are diagrams for describing the positions of alignment plates on a tray as viewed in a direction opposing a sheet discharge direction.
Figure 8B:
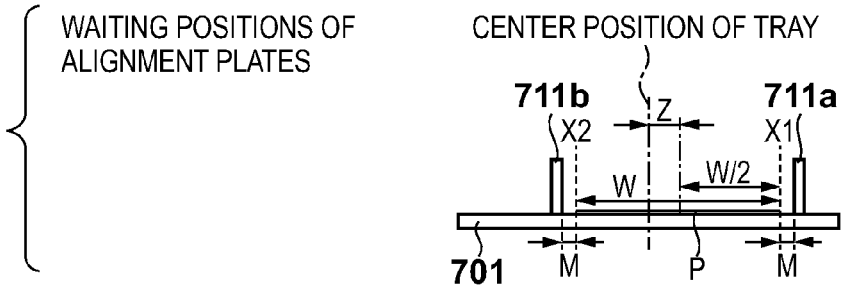
Figure 8C:
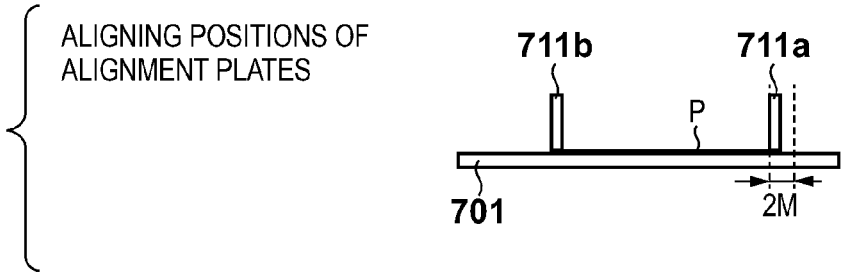
Figure 8D:
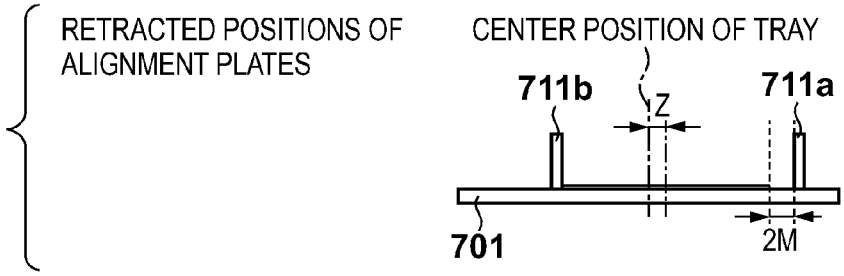

As shown in FIG. 8A, before a job is started, the pair of alignment plates 711*a* and 711*b* waits at default positions. As shown in FIG. 8B, once the job has been started, the front alignment plate 711*a* moves to an alignment waiting position that is distant from a front sheet edge position X1 by a predetermined retracted amount M. Note, the front sheet edge position X1 is distant from the center position of the stack tray 701 by a distance obtained by adding a shift amount Z to W/2 which is half of the sheet width. The alignment plate 711*a* waits at this alignment waiting position until a sheet is discharged. On the other hand, the back alignment plate 711*b* waits at an alignment waiting position that is distant from a back sheet edge position X2 by the predetermined retracted amount M. Note, the back sheet edge position X2 is distant from the center position of the stack tray 701 by a distance obtained by subtracting the shift amount Z from W/2 which is half of the sheet width. When a predetermined time period has elapsed since the sheet P was discharged onto the stack tray 701, the front alignment plate 711*a* moves toward the center of the stack tray 701 by a predetermined push amount 2M so as to press the sheet P against the stopped back alignment plate 711*b* as shown in FIG. 8C. As a result, the sheet P is moved toward the alignment plate 711*b* by the retracted amount M. When a predetermined period has elapsed since the sheet P was pressed against the alignment plate 711*b* in the above manner, the alignment plate 711*a* is retracted to the alignment waiting position as shown in FIG. 8D. More specifically, the alignment plate 711*a* is retracted away from the sheet P in the sheet width direction by 2M which is twice the retracted amount M, then waits until the next sheet is discharged onto the stack tray 701. Provided that the offset amount Z is 15 mm and the retracted amount M is 5 mm, the front alignment plate 711*a* pushes the sheet P by 5 mm during the alignment operations, and therefore the offset amount of the sheet P after the alignment operations is 10 mm. By repeating the above operations, a sheet P is aligned each time it is discharged onto the stack tray 701.

The following describes a flow of sheets during a shift-sort mode with reference to FIGS. 3, 7, 9A to 9G, and 10A to 10C. The shift-sort mode is set if the OK button is pressed while the "Sort" and "Shift" keys are selected on the finishing menu selection screen shown in FIG. 10B. Once the user has designated the shift-sort mode and entered a job, the CPU 901 in the CPU circuit unit 900 notifies the CPU 952 in the finisher controller 951 of the selection of the shift-sort mode, similarly to the case of a no sort mode. The following describes the operations for a shift-sort mode in the case where one "copy" is composed of three sheets.

When the image forming apparatus 10 discharges a sheet P to the finisher 500, the CPU 901 in the CPU circuit unit 900 notifies the CPU 952 in the finisher controller 951 of the start of sheet transfer. Upon receiving the notification of the start of sheet transfer, the CPU 952 drives and rotates the entrance motor M1, the buffer motor M2 and the discharge motor M3. As a result, the pairs of conveyance rollers 511, 512, 513, 514 and 515 shown in FIG. 7 are driven and rotated, thus making the finisher 500 receive and transfer the sheet P discharged from the image forming apparatus 10. When the conveyance path sensor 571 detects that the sheet P is held between the pair of conveyance rollers 512, the CPU 952 offsets the sheet P by moving the shift unit 580 through driving and rotation of the shift motor M5. At this time, the sheet P is offset by 15 mm toward the front when the shift information of the sheet P notified from the CPU 901 shows "front", and by 15 mm toward the back when the shift information of the sheet P notified from the CPU 901 shows "back". The switching flapper 541 is driven and rotated by the solenoid S1 to be situated in the position shown in FIG. 7, and the sheet P is directed to the upper discharge path 521. When the conveyance sensor 574 detects passing of the trailing edge of the sheet P, the CPU 952 discharges the sheet P onto the stack tray 701 by driving and rotating the discharge motor M3 so that the pair of conveyance rollers 515 rotates at a speed suited for stacking the sheet P.

The following describes the operations of the alignment plates at the time of the shifting, using the exemplary case where the shift direction is changed from the front to the back, with reference to FIGS. 9A to 9G. FIGS. 9A to 9G are diagrams for describing the positions of alignment plates on the stack tray 701 at the time of shift-sorting, as viewed in a direction opposing the sheet discharge direction.

Figure 9A:
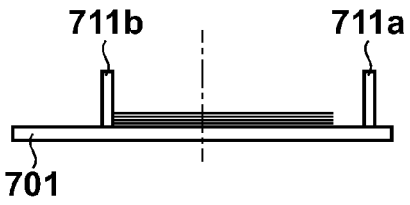
FIGS. 9A to 9G are diagrams for describing the positions of alignment plates on a tray during a shift-sort mode, as viewed in a direction opposing the sheet discharge direction.
Figure 9B:
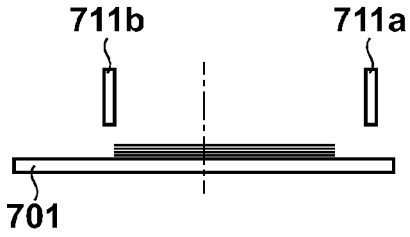

FIG. 9A shows the positions of alignment plates after sheets are aligned, that is to say, the state where the operation of retracting the front alignment plate 711*a* away from the sheets has finished (corresponding to FIG. 8D described above). Thereafter, as shown in FIG. 9B, the alignment plates 711*a* and 711*b* are raised upward away from the stack tray 701 by a predetermined amount.

Figure 9C:
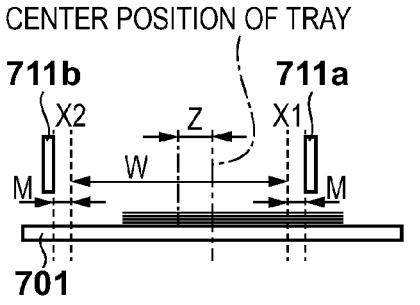

Next, the alignment plates 711*a* and 711*b* move in the sheet width direction to their respective alignment waiting positions for the next sheet. More specifically, on a bundle of sheets that are already stacked on the stack tray 701, a next sheet is to be discharged while being shifted toward the back compared to the bundle of already-stacked sheets. As shown in FIG. 9C, the front alignment plate 711*a* moves to an alignment waiting position that is distant from the front sheet edge position X1 by the predetermined retracted amount M. Note, the front sheet edge position X1 is distant from the center position of the stack tray 701 by a distance obtained by subtracting the shift amount Z from W/2 which is half of the sheet width. On the other hand, the back alignment plate 711*b* moves to an alignment waiting position that is distant from the back sheet edge position X2 by the predetermined retracted amount M. Note, the back sheet edge position X2 is distant from the center position of the stack tray 701 by a distance obtained by adding the shift amount Z to W/2 which is half of the sheet width.

Figure 9D:
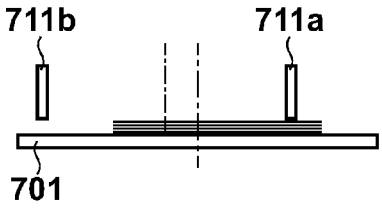

Once the alignment plates 711*a* and 711*b* have moved to their respective alignment waiting positions, the alignment plates 711*a* and 711*b* are lowered toward the stack tray 701 by a predetermined amount and wait until the next sheet is discharged onto the stack tray 701 as shown in FIG. 9D. At this time, the alignment plate 711*a* is in contact with (touches) the top surface of the topmost sheet of the already-stacked sheets.

Figure 9E:
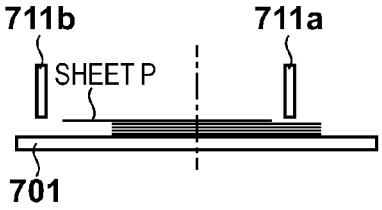
Figure 9F:
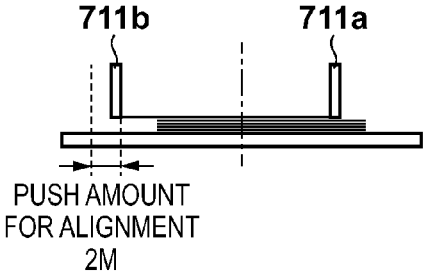
Figure 9G:
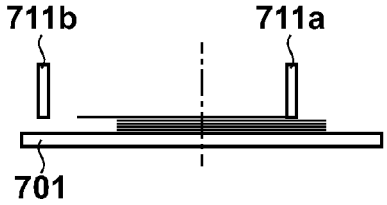

Thereafter, as shown in FIG. 9E, a sheet P is discharged onto the stack tray 701. When a predetermined time period has elapsed since the discharge, the alignment plate 711*b* moves toward the center of the stack tray 701 by the predetermined push amount 2M so as to press the sheet P against the alignment plate 711*a* as shown in FIG. 9F. When a predetermined time period has elapsed in the state of FIG. 9F, the alignment plate 711*b* is retracted away from the center of the stack tray 701 by the predetermined push amount 2M and waits until the next sheet is discharged onto the stack tray 701 as shown in FIG. 9G. It should be noted that the above operation for moving the alignment plate 711*b* toward the center of the stack tray 701 by the predetermined push amount 2M and then retracting the alignment plate 711*b* away from the center of the stack tray 701 by the predetermined push amount 2M (reciprocating operation) may be executed only once, or may be repeatedly executed for a predetermined number of times.

As described above, if the positions of sheets to be stacked are changed (shifted) in the width direction, the alignment plates are first raised upward away from the stack tray (FIG. 9C), then lowered after changing the aligning positions of the alignment plates so as to prepare for alignment of the sheets to be discharged next. Each time a sheet is discharged onto already-stacked sheets, sheet alignment operations are executed at the shifted positions.

In this case, the alignment plate 711*a* that is in contact with (touches) the top surface of the topmost sheet of the stacked sheets does not move; instead, the alignment plate 711*b* moves in a direction orthogonal to the sheet conveyance direction and applies the alignment operations to the newly-discharged sheet. This can prevent the alignment plate 711*a* from sliding against and staining the top surface of the topmost sheet of the stacked sheets, or at least reduce the stain.

If a "Select Discharge Destination" key is selected on the finishing menu selection screen shown in FIG. 10A, a discharge destination selection screen shown in FIG. 10C is displayed on the display unit 420. If the user selects a discharge destination and presses the OK button on this discharge destination selection screen, the discharge destination is selected ("Upper Tray" is selected in FIG. 10C). Thereafter, the finishing menu selection screen shown in FIG. 10A is displayed on the display unit 420 again.

The following describes different width-mixed stack, in which a plurality of types of sheets having different widths are stacked on a stack tray. If the "Select Sheet" key 418 is pressed on the screen shown in FIG. 3, the screen is switched to the sheet feeding tray selection screen shown in FIG. 11. If the user selects an "Automatic Selection" key on this sheet feeding tray selection screen, an automatic sheet selection mode is set in which a sheet feeding tray of sheets having a size corresponding to the size of an original is automatically selected. If the user presses an "Applied Mode" key 419 on the screen shown in FIG. 3, the screen is switched to an applied mode selection screen shown in FIG. 12A. If the user presses a "Size-Mixed Stack" key on the applied mode selection screen, the applied mode selection screen is switched to a size-mixed stack screen shown in FIG. 12B. If the user selects a "Different Widths" key and presses the OK button on this screen, a different width-mixed stack mode is set. If the user presses the start key 402 on the console unit 400 in this state, a plurality of originals stacked on the document feeder 100 are fed one by one, and a copy process is executed by automatically selecting sheet feeding trays that house sheets corresponding to different original sizes. In this way, sheets corresponding to different original sizes are fed and printed. As a result, a plurality of sheets having different widths are stacked on a stack tray in a mixed manner.

Also, in the case where data generated by a computer is received and printed instead of copying images of originals, if the data includes a mixture of pages with different image sizes, a plurality of printed sheets having different widths will be stacked on a stack tray in a mixed manner.

The above has described an example of different width-mixed stack that occurs in one print job. The following describes different width-mixed stack that occurs in two print jobs.

If the user selects the "Select Sheet" key 418 on the screen shown in FIG. 3, the screen is switched to the sheet feeding tray selection screen shown in FIG. 11. It is assumed here that the user selects a sheet feeding tray corresponding to "A4". When printing is performed in this state, A4-sized printed sheets are stacked on a stack tray. Now, assume that the user subsequently selects the "Select Sheet" key 418 on the screen shown in FIG. 3 and selects a sheet feeding tray corresponding to "B5" on the screen shown in FIG. 11. In this case, if printing is performed without changing a discharge destination for sheets, the B5-sized sheets printed in the subsequent job are stacked on the A4-sized printed sheets that were stacked on the stack tray in the immediately preceding print job.

Also, in the case where data generated by a computer is received and printed instead of copying images of originals, if sheets to be used in different print jobs have different sizes, a plurality of sheets having different widths will be stacked on a stack tray in a mixed manner. When sheets having a smaller width than printed sheets that are already stacked on a tray are to be stacked and aligned on the already-stacked sheets, it is necessary to prevent the alignment plates from sliding against the topmost sheet of the already-stacked sheets during the movement for the alignment (reciprocating operations). Therefore, when sheets having a smaller width than printed sheets that are already stacked on a tray are to be stacked on the already-stacked sheets, printing may be interrupted. However, such interruption reduces the productivity. In view of this, the following describes the example in which images are printed on sheets and the printed sheets are discharged if the discharged sheets need not be aligned, and the example in which the alignment process is executed whenever possible if the alignment plates do not slide against the topmost sheet of the already-stacked sheets during the execution of the alignment process.

First Embodiment

Figure 13:
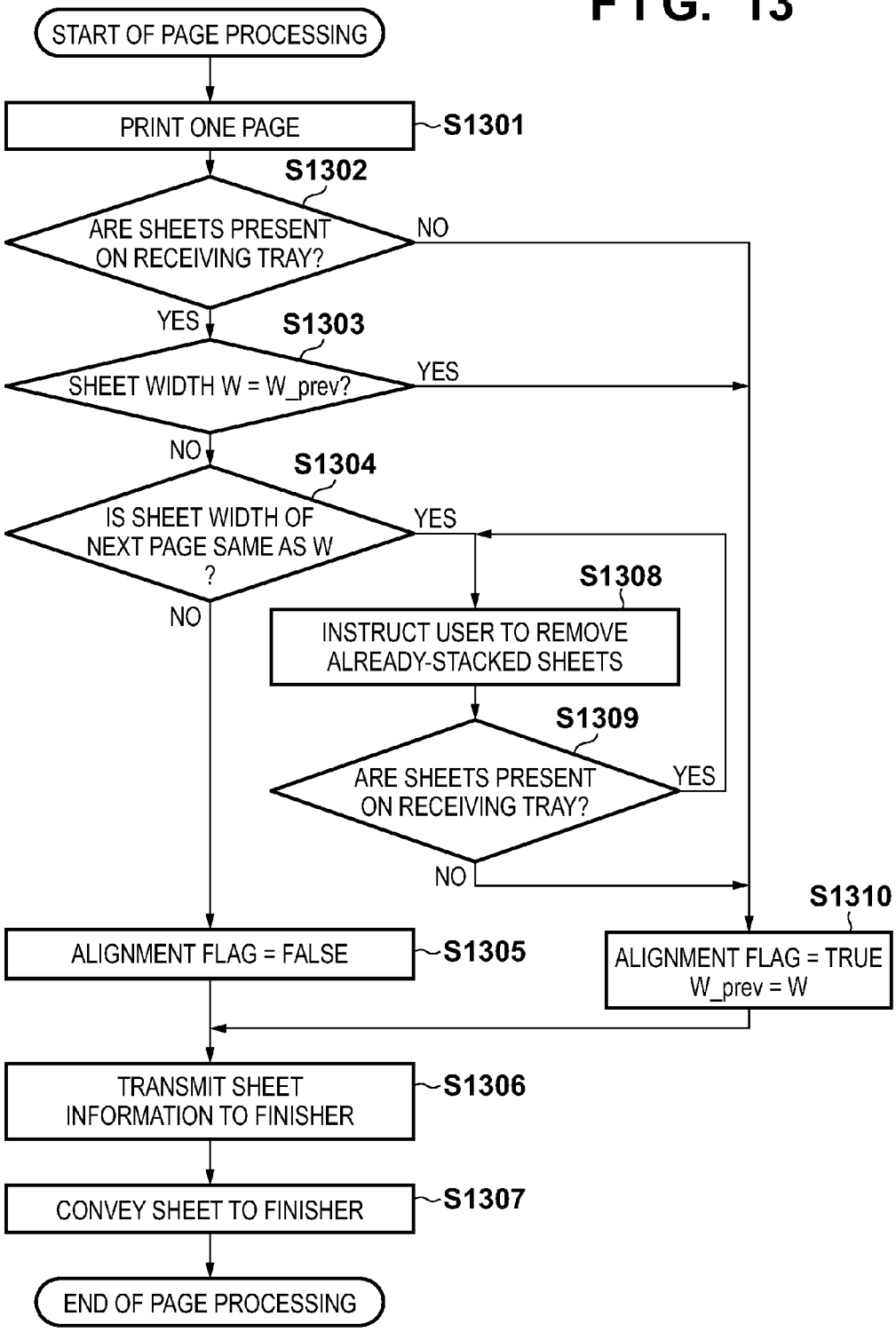
FIG. 13 is a flowchart for describing processing in which an image forming apparatus according to some embodiments prints a sheet and discharges the printed sheet to a finisher.

A description is now given of page printing operations executed by the CPU 901 in the CPU circuit unit 900 in the controller according to the present first embodiment with reference to a flowchart of FIG. 13.

FIG. 13 is a flowchart for describing processing in which the image forming apparatus 10 according to the present first embodiment prints a sheet and discharges the printed sheet onto the finisher 500. A program for executing this processing is stored in the ROM 902. This processing is realized by the CPU 901 executing the stored program.

First, in step S1301, the CPU 901 identifies the size of a sheet P to be used in printing based on the input print settings and image data, and controls the printer controller 931 to print an image on a sheet of the identified size. Then, the CPU 901 proceeds to step S1302 and determines, based on the input from the sheet presence detecting sensor 730 or 731, whether or not sheets that have already been printed (first sheets) are placed on a stack tray onto which the printed sheet P should be discharged. Note that the stack tray onto which the printed sheet P should be discharged may be decided on in accordance with the input print settings, or may have been decided on as the setting for the image forming apparatus 10. The CPU 901 proceeds to step S1303 if it determines that sheets are placed on the stack tray onto which the sheet P (second sheet) should be discharged, and to step S1310 if it determines that sheets are not placed on the stack tray onto which the sheet P (second sheet) should be discharged. In step S1303, the CPU 901 determines whether or not the sheet width W of the printed sheet P is equal to the width of the already-stacked sheets, that is to say, a variable W_prev that is stored in the memory unit 903 and indicates the sheet width of a preceding sheet. The CPU 901 proceeds to step S1310 if it determines that the sheet width W of the printed sheet P is equal to W_prev, and to step S1304 if it determines otherwise. In step S1310, the CPU 901 sets an alignment flag to "TRUE" so as to apply an alignment process to the discharged sheet P.

In step S1304, the CPU 901 determines whether or not the sheet width of a page that is to be printed next to the sheet P is equal to the sheet width W of the sheet P. That is to say, the CPU 901 determines whether or not a sheet having the same width as the sheet P is to be continuously printed after the sheet P. The CPU 901 proceeds to step S1308 if it determines that the sheet having the same width as the sheet P is to be continuously printed after the sheet P, and proceeds to step S1305 if it determines otherwise. The CPU 901 sets the alignment flag to "FALSE" in step S1305, then proceeds to step S1306. Note that the alignment flag is a variable indicating whether or not the finisher 500 should execute the alignment process. In this way, the setting is made such that the alignment process is not applied to the sheet P if a sheet having the same width as the sheet P is not to be continuously printed after the sheet P. Note that the alignment flag is stored in the memory unit 903.

Then, in step S1306, the CPU 901 notifies the CPU 952 in the finisher controller 951 in the finisher 500 of later-described sheet information, and proceeds to step S1307. In step S1307, the CPU 901 controls the printer controller 931 to convey the sheet P printed in step S1301 to the finisher 500, and finishes the page printing operations for one page.

Figure 15:
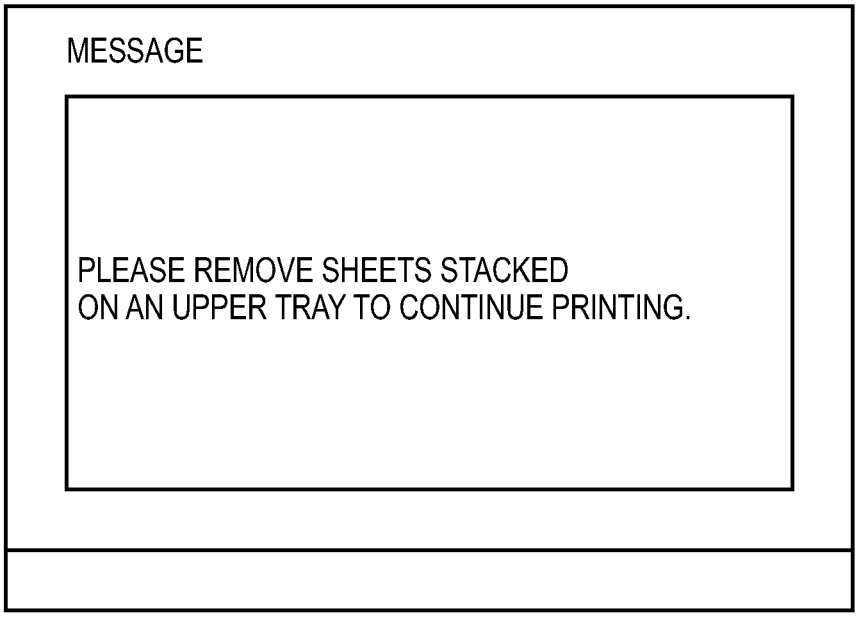
FIG. 15 shows an example of a message that is displayed on a display unit if a sheet P is determined to have the same width as a page to be printed next upon discharging the sheet P onto an upper tray.

On the other hand, if the CPU 901 determines in step S1304 that the sheet P and the page to be printed next have the same sheet width, the CPU 901 proceeds to step S1308, causes the console unit controller 941 to display a message shown in FIG. 15 on the display unit 420, and proceeds to step S1309.

FIG. 15 shows an example of a message that is displayed on the display unit if the sheet P and the page to be printed next are determined to have the same sheet width upon discharging the sheet P onto the upper tray.

Specifically, the display unit displays the message "Please remove sheets stacked on an upper tray to continue printing" so as to prompt the user to remove the stacked sheets.

Then, in step S1309, the CPU 901 repeatedly executes steps S1308 and S1309 until it determines that no sheet is placed on the stack tray based on the input from the sheet presence detecting sensor 730 or 731.

The CPU 901 proceeds to step S1310 if it determines that the sheets on the stack tray have been removed and thus gone. In step S1310, the CPU 901 sets the alignment flag to "TRUE" and substitutes the width W of the sheet P into W_prev, then proceeds to step S1306. In the above manner, if a sheet having the same width as the sheet P follows immediately after the sheet P, an alignment process is applied to the sheet P and the following sheet after the printed sheets that preceded the sheet P are removed from the stack tray 701.

It should be noted here that the finisher 500 executes the sheet alignment process if the alignment flag is set to "TRUE", and does not execute the sheet alignment process if the alignment flag is set to "FALSE".

As described above, in a print process for one page according to the first embodiment, if sheets are already stacked on a tray onto which the printed sheet P should be discharged and these already-stacked sheets have the same width as the sheet P, the discharge and alignment processes for the sheets are continuously executed. On the other hand, if the already-stacked sheets do not have the same width as the sheet P, whether or not a sheet that follows the sheet P has the same width as the sheet P is determined; if the sheet that follows the sheet P has the same width as the sheet P, it is determined that the alignment process needs to be applied to the sheet P and the sheet that follows the sheet P, and the user is instructed to remove the already-stacked sheets. If the already-stacked sheets do not have the same width as the sheet P and the sheet that follows the sheet P does not have the same width as the sheet P, or no sheet follows the sheet P, it is determined that the sheet alignment process is unnecessary, and the alignment process is not applied to printed sheets thereafter.

Figure 14A:
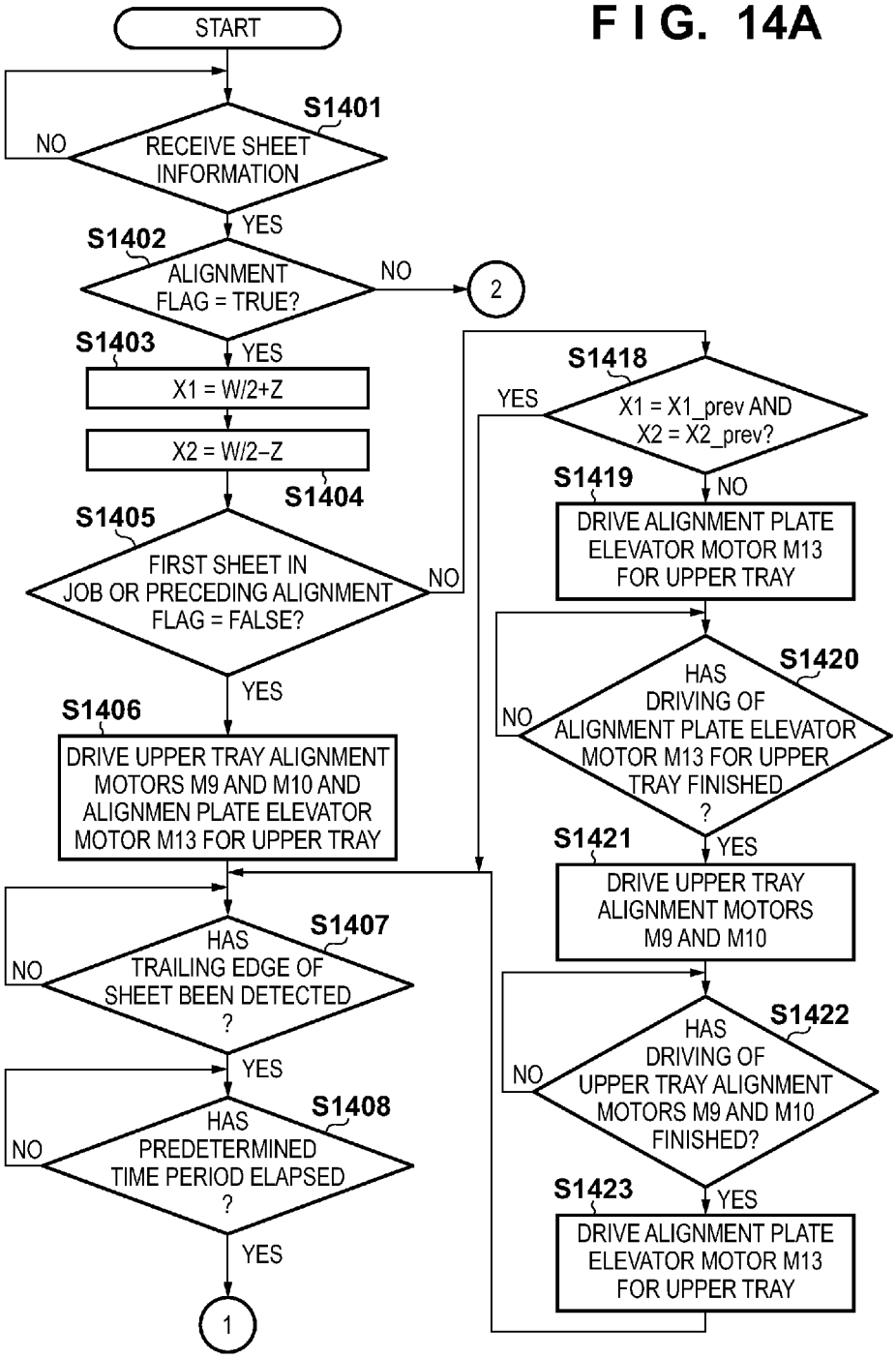
FIG. 14A and FIG. 14B are flowcharts for describing discharge operations executed by a finisher according to some embodiments.
Figure 14B:
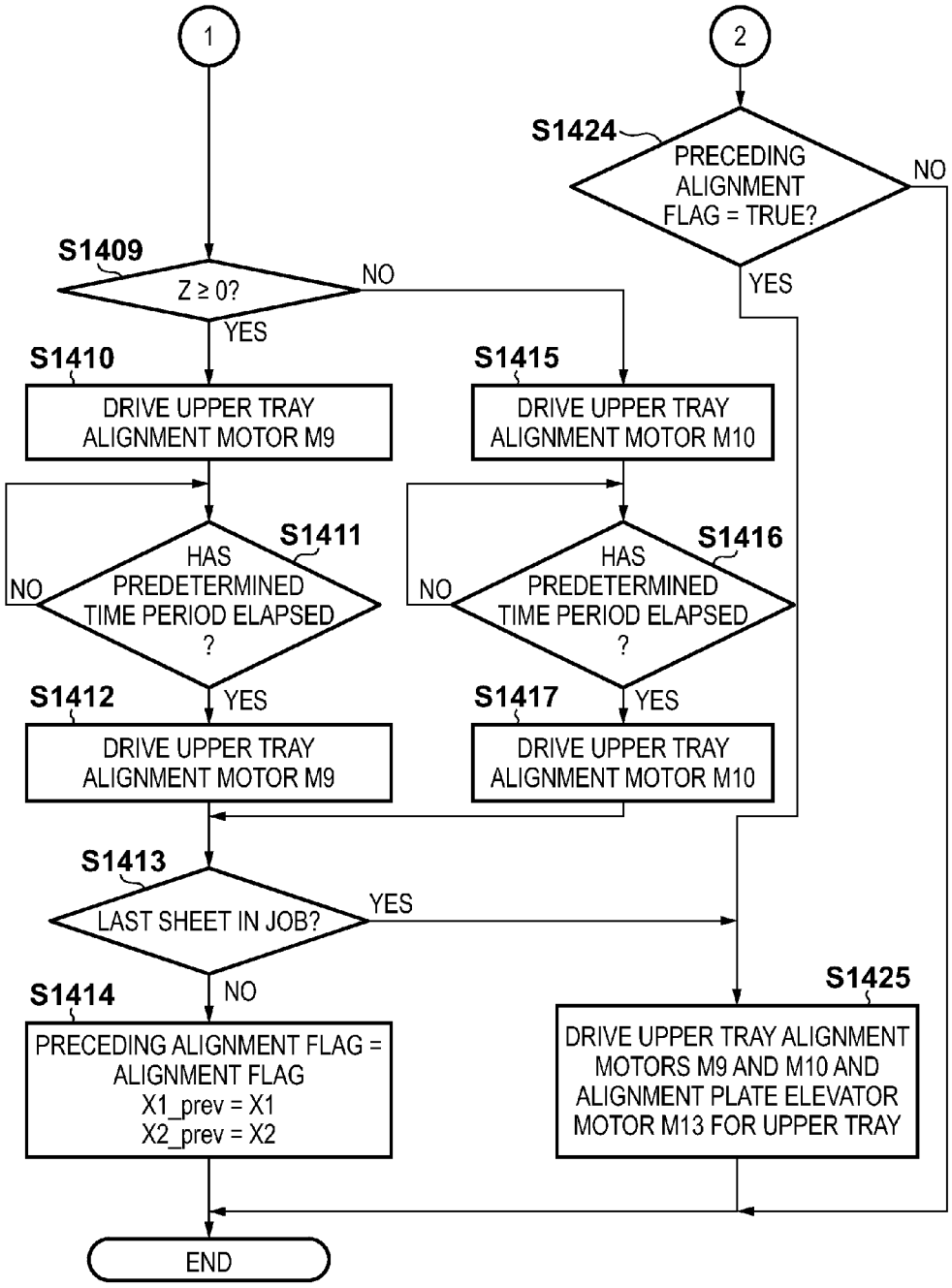

Next, a description is given of the discharge operations executed by the CPU 952 in the finisher controller 951 according to the present first embodiment with reference to flowcharts of FIGS. 14A and 14B.

FIGS. 14A and 14B are flowcharts for describing the discharge operations executed by the finisher 500 according to the present first embodiment. A program for executing processing of the flowchart is stored in the ROM 953 in the finisher controller 951. This processing is realized by the CPU 952 executing the stored program. Alternatively, this processing may be executed by the finisher 500 by storing the program for executing this processing in the ROM 902 and causing the CPU 901 in the image forming apparatus 10 to execute this program.

First, in step S1401, the CPU 952 determines whether or not it has been notified of sheet information by the CPU 901 in the image forming apparatus 10. This sheet information includes, for example, job information indicating whether the sheet P is the first sheet or the last sheet in the job, the sheet width W, the offset amount Z, and the alignment flag indicating whether or not to execute the alignment process. This sheet information may include information related to a single job, or information related to a plurality of jobs. The CPU 952 proceeds to step S1402 if it has been notified of the sheet information, and returns to step S1401 if it has not been notified of the sheet information. In step S1402, the CPU 952 refers to the value of the alignment flag, and proceeds to step S1403 if the flag is set to "TRUE" and to step S1424 if the flag is set to "FALSE". In step S1403, the CPU 952 calculates the front sheet edge position X1 shown in FIG. 8B based on the sheet width W and the offset amount Z using the following equation 1, stores the calculated front sheet edge position X1 in the RAM 954, and proceeds to step S1404.

$$X1=W/2+Z \quad \text{[Equation 1]}$$

Next, in step S1404, the CPU 952 calculates the back sheet edge position X2 shown in FIG. 8B based on the sheet width W and the offset amount Z using the following equation 2, stores the calculated back sheet edge position X2 in the RAM 954, and proceeds to step S1405.

$$X2=W/2-Z \quad \text{[Equation 2]}$$

Then, in step S1405, the CPU 952 determines, based on the sheet information, whether or not the current sheet P is the first sheet in the print job, or whether or not the alignment operations were targeted for a preceding sheet based on the value of the alignment flag for the preceding sheet. The CPU 952 proceeds to step S1406 if it determines that the current sheet P is the first sheet in the job or that the preceding alignment flag is set to "FALSE", and to step S1418 if it determines otherwise. In step S1406, the CPU 952 drives and rotates the upper tray alignment motors M9 and M10 and the alignment plate elevator motor M13 for the upper tray so as to move the alignment plates 711 from the default positions shown in FIG. 8A to the waiting positions shown in FIG. 8B, then proceeds to step S1407. At this time, the CPU 952 refers to the values X1 and X2 calculated earlier.

In step S1407, the CPU 952 determines whether or not the trailing edge of the sheet P has been detected based on the output from the conveyance sensor 574. The CPU 952 proceeds to step S1408 if the trailing edge of the sheet P has been detected, and returns to step S1407 if the trailing edge of the sheet P has not been detected. In step S1408, the CPU 952 determines whether or not a predetermined time period has elapsed since the trailing edge of the sheet P was detected. The CPU 952 proceeds to step S1409 if the predetermined time period has elapsed, and returns to step S1408 if the predetermined time period has not elapsed.

In step S1409, the CPU 952 determines the shift direction for the sheet P based on the offset amount Z included in the sheet information. If the value of Z is larger than or equal to 0, the CPU 952 determines that the front shift is to be performed and proceeds to step S1410. If the value of Z is smaller than 0, the CPU 952 determines that the back shift is to be performed and proceeds to step S1415. In step S1410, the CPU 952 drives the upper tray alignment motor M9 so as to execute the alignment operations by moving the alignment plate 711*a* toward the center of the stack tray and pressing the sheet P against the stopped alignment plate 711*b* as shown in FIG. 8C. Then, the CPU 952 proceeds to step S1411 and determines whether or not a predetermined time period has elapsed since the alignment plate 711*a* was moved. If the predetermined time period has elapsed, the CPU 952 proceeds to step S1412. In step S1412, the CPU 952 drives the upper tray alignment motor M9 so as to move the alignment plate 711*a* away from the sheet P in the sheet width direction as shown in FIG. 8D. Then, the CPU 952 proceeds to step S1413 and determines whether or not the current sheet P is the last sheet in the job based on the sheet information. The CPU 952 proceeds to step S1425 if the sheet P is the last sheet, and to step S1414 if the sheet P is not the last sheet. In step S1414, the CPU 952 substitutes the value of the current alignment flag into the preceding alignment flag, X1 into X1_prev, and X2 into X2_prev. After storing them in the RAM 954, the CPU 952 ends the processing.

On the other hand, if the CPU 952 determines in step S1409 that the value of Z is smaller than 0 and therefore the back shift is to be performed, the CPU 952 proceeds to step S1415. In step S1415, the CPU 952 drives and rotates the upper tray alignment motor M10 so as to execute the alignment operations by moving the alignment plate 711*b* toward the center of the stack tray and pressing the sheet against the stopped alignment plate 711*a*. Then, the CPU 952 proceeds to step S1416 and determines whether or not a predetermined time period has elapsed since the alignment plate 711*b* was moved. If the predetermined time period has elapsed, the CPU 952 proceeds to step S1417, and drives and rotates the upper tray alignment motor M10 so as to move the alignment plate 711*b* away from the sheet P in the sheet width direction. The CPU 952 then proceeds to step S1413.

In this way, the alignment process is applied to the first sheet in the job or to a sheet P for which the alignment process is started, and the values of the current alignment flag, X1 and X2 are stored in the RAM 954 to prepare for the next sheet.

On the other hand, if the current sheet P is not the first sheet in the job and the preceding alignment flag is set to "TRUE" in step S1405, the CPU 952 proceeds to step S1418 and compares X1 and X2 respectively with X1_prev and X2_prev that are stored in the RAM 954. If X1 is equal to X1_prev and X2 is equal to X2_prev, the current sheet P is to be stacked at the same position as the preceding sheet, and therefore the CPU 952 proceeds to step S1407. Otherwise, the CPU 952 proceeds to step S1419 and changes the waiting positions of the alignment plates 711.

In step S1419, the CPU 952 drives and rotates the alignment plate elevator motor M13 for the upper tray such that, as shown in FIG. 9B, the alignment plates 711*a* and 711*b* are raised off the stack tray 701 by a predetermined amount. Then, the CPU 952 proceeds to step S1420 and determines whether or not the driving and rotation of the alignment plate elevator motor M13 for the upper tray have finished. If the driving has finished, the CPU 952 proceeds to step S1421. In step S1421, the CPU 952 drives and rotates the upper tray alignment motors M9 and M10 so as to move the alignment plates 711*a* and 711*b* in the sheet width direction to the alignment waiting positions for the next sheet, and proceeds to step S1422. In this step S1421, the waiting positions of the alignment plates 711*a* and 711*b* are decided on in accordance with the values of X1 and X2 calculated in steps S1403 and S1404. Then, the CPU 952 proceeds to step S1422 and determines whether or not the driving and rotation of the upper tray alignment motors M9 and M10 have finished. If the driving has finished, the CPU 952 proceeds to step S1423. In step S1423, the CPU 952 drives and rotates the alignment plate elevator motor M13 for the upper tray so as to move the alignment plates 711*a* and 711*b* toward the stack tray 701 by a predetermined amount as shown in FIG. 9D. Thereafter, the CPU 952 proceeds to step S1407.

As described above, in steps S1419 to S1423, if a sheet P having a different width from a preceding sheet is to be discharged, the waiting positions of the alignment plates 711*a* and 711*b* are adjusted in accordance with the width of the sheet P so that the alignment plates 711*a* and 711*b* can wait for the alignment process for the sheet P.

Furthermore, if the alignment flag is set to "FALSE" in step S1402, the CPU 952 proceeds to step S1424 and determines whether or not the alignment operations were applied to the preceding sheet based on the value of the preceding alignment flag stored in the RAM 954. The CPU 952 proceeds to step S1425 if it determines that the alignment operations were applied to the preceding sheet, that is to say, the preceding alignment flag is set to "TRUE". The CPU 952 proceeds to END if it determines otherwise. In step S1425, the CPU 952 drives and rotates the upper tray alignment motors M9 and M10 and the alignment plate elevator motor M13 for the upper tray so as to move the alignment plates 711*a* and 711*b* to the default positions shown in FIG. 8A. Thereafter, the CPU 952 proceeds to END. In this way, the alignment plates 711*a* and 711*b* can be retracted away from a sheet P for which the alignment process is not necessary.

Although the above first embodiment has described the case where a sheet P is discharged onto the stack tray 701, similar operations are executed also in the case where the sheet P is discharged onto the stack tray 700. In this case, the CPU 952 detects the trailing edge of the sheet P based on the output from the conveyance sensor 576, and executes the alignment operations by driving and rotating the lower tray alignment motors M11 and M12 and the alignment plate elevator motor M14 for the lower tray.

When one or more sheets having a different sheet width from sheets that are already stacked on a stack tray are to be stacked directly on the already-stacked sheets, if the number of such sheets that have the different sheet width and follow the already-stacked sheets is only one, the sheet processing apparatus according to the present first embodiment can prevent the alignment process from being applied to that sheet.

If two or more sheets having a different sheet width from the already-stacked sheets are to be continuously stacked directly on the already-stacked sheets, the sheet processing apparatus according to the present first embodiment interrupts the print process and displays a message for guiding the user to remove the already-stacked sheets from the tray to the user. In this way, if it is determined that the alignment quality for the already-stacked sheets will be reduced, the printing is interrupted, thus preventing reduction in the alignment quality. On the other hand, if it is determined that the alignment quality will not be reduced, the discharge process can be continued without interrupting the printing, thus improving the usability.

Second Embodiment

In the above-described first embodiment, if the number of sheets that have a different width from the already-stacked sheets and are to be discharged onto the already-stacked sheets is only one, it is determined that the alignment quality will not be reduced even without executing the alignment process. In contrast, the second embodiment describes the example in which the user can set the number of sheets that have a different width from the already-stacked sheets and are allowed to be stacked on the already-stacked sheets without executing the alignment process. Note that a configuration of an image forming system according to the present second embodiment is the same as the configuration of the image forming system according to the above-described first embodiment, and therefore a description thereof is omitted. In the present second embodiment, only features that are different from the first embodiment are described, and constituent elements having the same configurations as those in the first embodiment are described using the same reference numbers thereas.

Figure 12A:
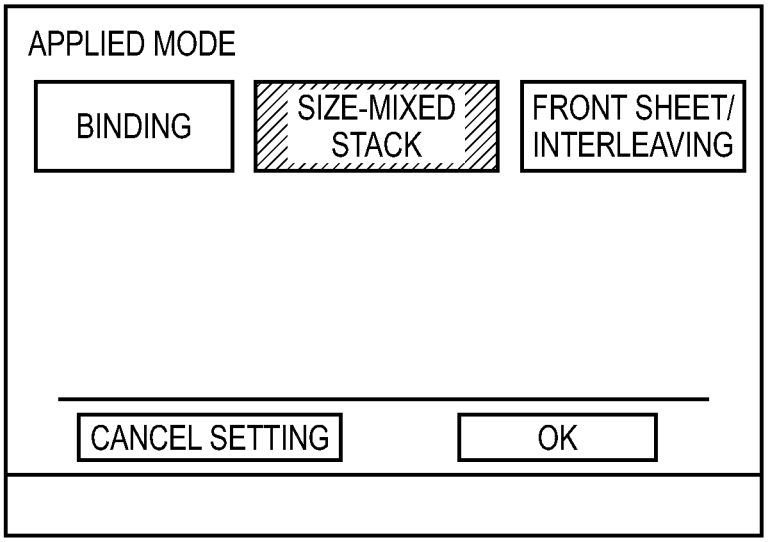
FIGS. 12A and 12B show screens for setting a size-mixed stack mode.
Figure 12B:
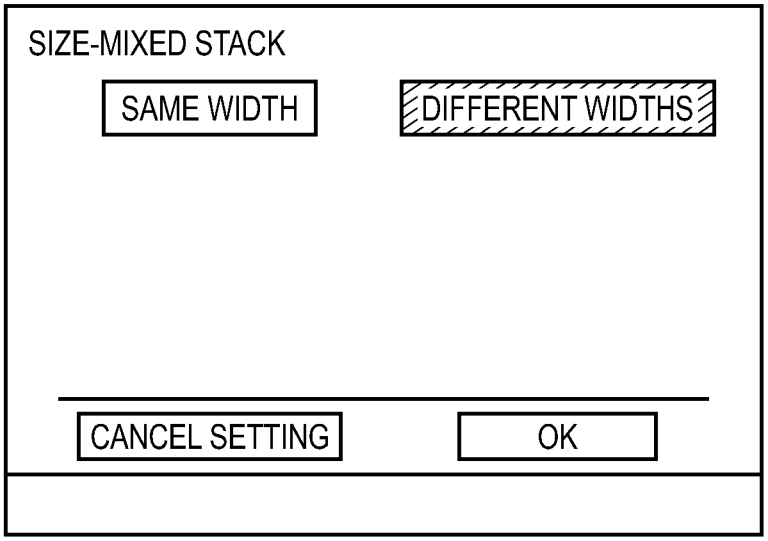
Figure 16:
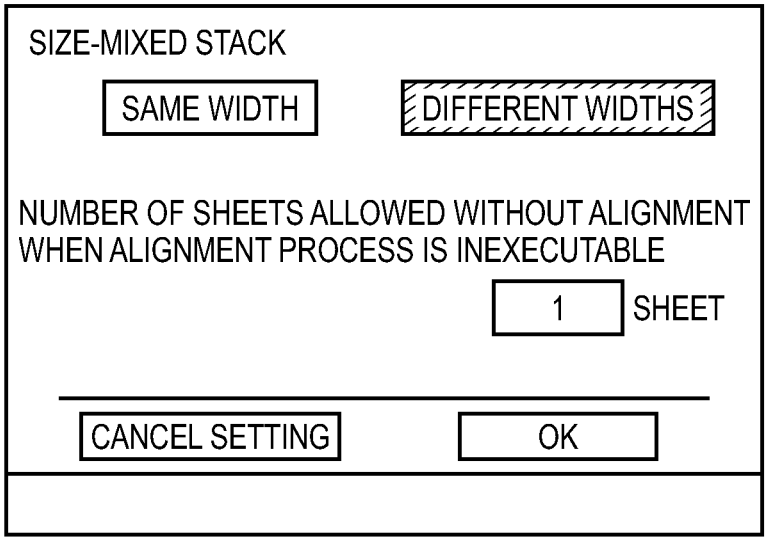
FIG. 16 shows an example of a size-mixed stack screen that allows size-mixed stack according to some embodiments.

If the user presses the "Size-Mixed Stack" key on the applied mode selection screen shown in FIG. 12A, the applied mode selection screen is switched to a size-mixed stack screen shown in FIG. 16.

FIG. 16 shows an example of the size-mixed stack screen that allows size-mixed stack according to the second embodiment.

The user sets the different width-mixed stack mode by selecting a "Different Widths" key on this screen. At this time, the user can set the number of sheets that have different widths and are allowed to be stacked without the alignment process by designating a number under "Number of Sheets Allowed without Alignment When Alignment Process is Inexecutable". This number of allowed sheets is input using the numeric keys 404 to 413 on the console unit 400. Furthermore, if the user presses the OK button after setting the number of allowed sheets, the settings for size-mixed stack input on this screen are confirmed and stored in the memory unit 903. While the above has described the example in which different width-mixed stack occurs in one print job, a similar setting screen may be provided for different width-mixed stack that occurs between two print jobs to enable the setting of the number of sheets that have different widths and are allowed to be stacked without the alignment process.

Figure 17:
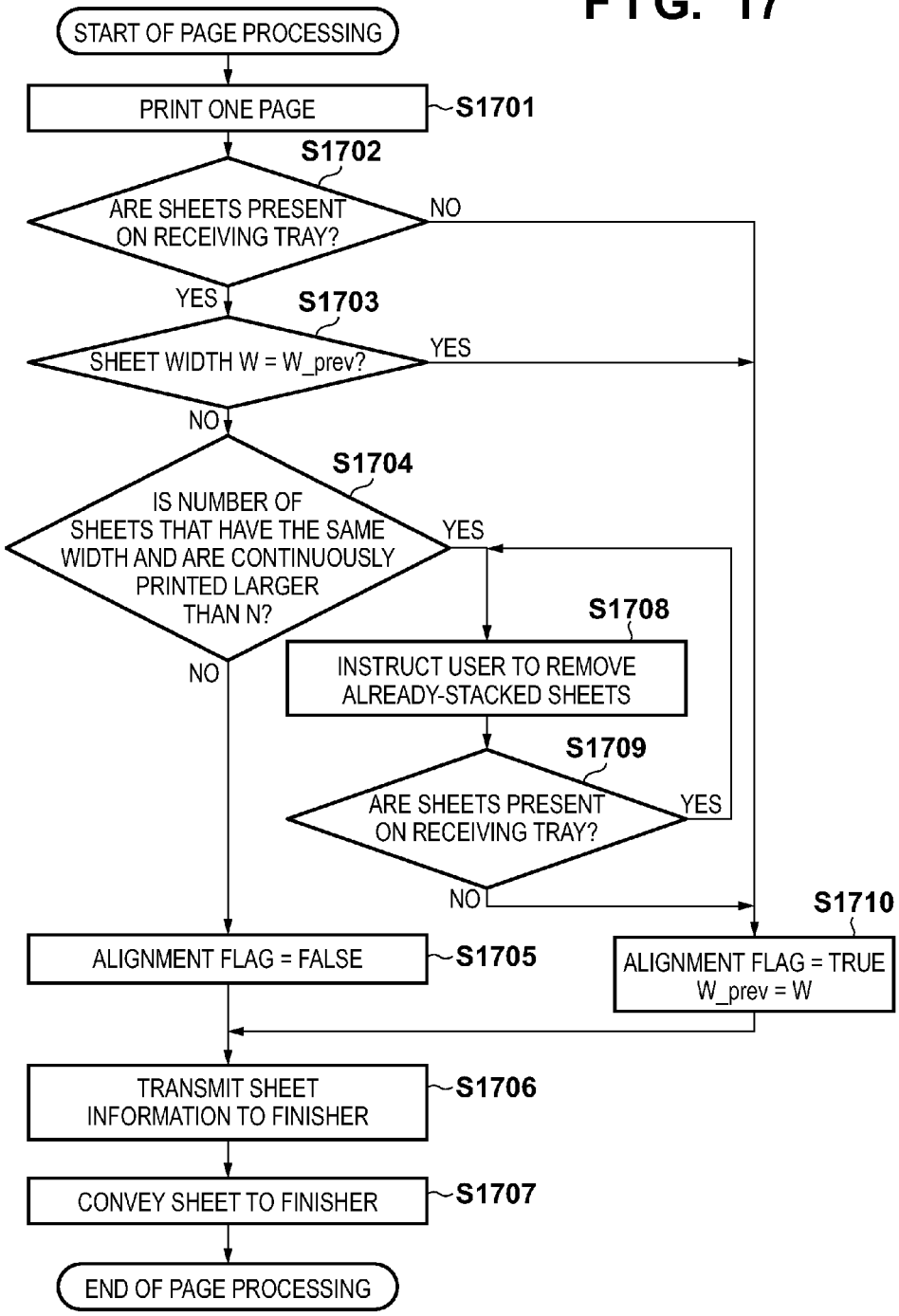
FIG. 17 is a flowchart for describing processing in which an image forming apparatus according to some embodiments prints a sheet and discharges the printed sheet to a finisher.

A description is now given of page printing operations executed by the CPU 901 in the CPU circuit unit 900 in the controller according to the present second embodiment with reference to a flowchart of FIG. 17.

FIG. 17 is a flowchart for describing processing in which the image forming apparatus 10 according to the present second embodiment prints a sheet and discharges the printed sheet onto a finisher. A program for executing this processing is stored in the ROM 902. This processing is realized by the CPU 901 executing the stored program. In this flowchart of FIG. 17, the processes of steps S1701 to S1703 are the same as the processes of steps S1301 to S1303 in the flowchart of FIG. 13, and therefore a description thereof is omitted.

In step S1704, the CPU 901 determines whether or not the number of sheets that have the same width as a sheet P and are to be continuously printed is larger than N. Note that the number N is the number of allowed sheets that was set on the screen shown in FIG. 16. The CPU 901 proceeds to step S1708 if it determines that the number of such sheets is larger than N, and to step S1705 if it determines otherwise. In step S1705, the CPU 901 sets the alignment flag to "FALSE" so that the alignment process is not executed. In step S1708, as the number of sheets for which printing is to be continuously performed is larger than the number of allowed sheets, the CPU 901 issues an instruction for removing sheets stacked on the stack tray 701 so that the alignment process can be applied to the sheets that are to be discharged.

In the flowchart of FIG. 17, the processes of steps S1705 to S1710 are the same as the processes of steps S1305 to S1310 in the flowchart of FIG. 13, and therefore a specific description thereof is omitted.

In the above manner, if the number of sheets that have the same width as the sheet P and are to be printed is larger than the number N of sheets allowed without alignment, a message for guiding the user to remove sheets stacked on a tray is displayed to the user. After the sheets on the tray are removed, the printed sheets are discharged onto the tray and the alignment plates apply the alignment process thereto. On the other hand, if the number of sheets that have the same width as the sheet P and are to be printed is smaller than or equal to the number N of sheets allowed without alignment, the process for stacking the printed sheets on the tray is continued without executing the alignment process. In this way, the print process can be continued without interruption.

As described above, according to the second embodiment, when one or more sheets having a different width from sheets that are already stacked on a stack tray are to be stacked directly on the already-stacked sheets, if the number of such sheets having the different width is smaller than or equal to a predetermined number, it is possible to prevent the alignment process from being applied to such sheets having the different width. On the other hand, if the number of such sheets that have the different width and are to be continuously printed is larger than the predetermined number, the print process is interrupted, and a message for guiding the user to remove the already-stacked sheets is displayed to the user. Note that the aforementioned "predetermined number" can be changed by the user as appropriate. In the above manner, if it is determined that the alignment quality for the already-stacked sheets will be reduced, the printing is interrupted so as to prevent reduction in the alignment quality. On the other hand, if it is determined that the alignment quality for the already-stacked sheets will not be reduced, the discharge process can be continued without interrupting the print process, thereby improving the usability.

Third Embodiment

In the above-described second embodiment, if the number of sheets that have a different sheet width from already-stacked sheets and are to be continuously printed is larger than the predetermined number, the printing is interrupted so as to prevent reduction in the alignment quality. However, if the sheets to be continuously printed have a larger width than the preceding already-stacked sheets, the alignment process can be executed without the alignment plates sliding against the front surface of the already-stacked sheets. In view of this, the third embodiment describes the example in which, if sheets have a larger width than the preceding sheets, the alignment process is executed without interrupting the printing. Note that a configuration of an image forming system according to the present third embodiment is the same as the configurations of the image forming systems according to the above first and second embodiments, and therefore a description thereof is omitted. In the present third embodiment, only features that are different from the above first and second embodiments are described, and constituent elements having the same configurations as those in the above first and second embodiments are described using the same reference numbers thereas.

Figure 18:
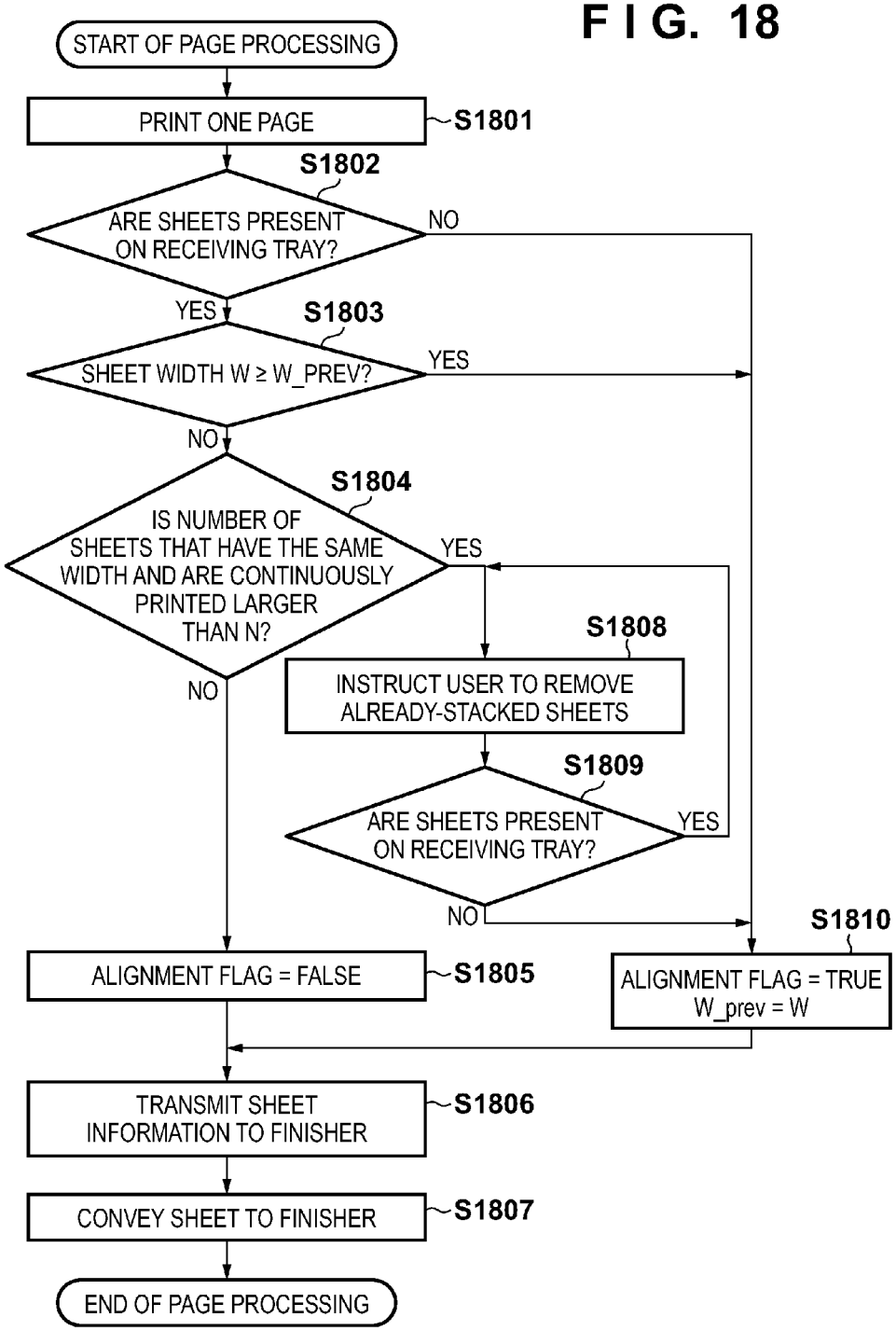
FIG. 18 is a flowchart for describing processing in which an image forming apparatus according to some embodiments prints a sheet and discharges the printed sheet to a finisher.

A description is now given of page printing operations executed by the CPU 901 in the CPU circuit unit 900 in the controller according to the present third embodiment with reference to a flowchart of FIG. 18.

FIG. 18 is a flowchart for describing processing in which the image forming apparatus 10 according to the present third embodiment prints a sheet and discharges the printed sheet onto a finisher. A program for executing this processing is stored in the ROM 902. This processing is realized by the CPU 901 executing the stored program. In this flowchart of FIG. 18, the processes of steps S1801 and S1802 are the same as the processes of steps S1701 and S1702 in the flowchart of FIG. 17, and therefore a description thereof is omitted.

In step S1803, the CPU 901 determines whether or not the sheet width W of a printed sheet P is larger than or equal to a variable W_prev that is stored in the memory unit 903 and indicates the sheet width of a preceding sheet. The CPU 901 proceeds to step S1810 and continues the alignment process if it determines that the sheet width W of the printed sheet P is larger than or equal to the sheet width of the preceding sheet, and to step S1804 if it determines otherwise. In the flowchart of FIG. 18, the processes of steps S1804 to S1810 are the same as the processes of steps S1704 to S1710 in the flowchart of FIG. 17, and therefore a description thereof is omitted. Specifically, in the present flowchart, in the case where the sheet width W of the printed sheet P is larger than or equal to the sheet width of the preceding sheet, the alignment flag is set to "TRUE" and the alignment process is executed. On the other hand, in the case where the sheet width W of the printed sheet P is smaller than the sheet width of the preceding sheet, the alignment flag is set to "FALSE" and the alignment process is not executed if the number of subsequent sheets is smaller than or equal to the predetermined number N. If the number of subsequent sheets is larger than the predetermined number N, the alignment quality could possibly be reduced, and therefore the stacking and alignment processes for the subsequent sheets are executed after the user removes the already-stacked sheets.

As described above, according to the third embodiment, when sheets having a smaller sheet width than sheets that are already stacked on a stack tray are to be continuously stacked directly on the already-stacked sheets, the alignment process is not applied to the sheets having the smaller sheet width if the number of sheets having the smaller sheet width does not exceed the predetermined number. On the other hand, if the number of sheets having the smaller sheet width exceeds the predetermined number, the print process is interrupted, and a message for guiding the user to remove the already-stacked sheets is displayed to the user. Furthermore, when sheets having the same sheet width as or a larger sheet width than sheets that are already stacked on a stack tray are to be stacked directly on the already-stacked sheets, the alignment process is executed without interrupting printing.

In this way, if it is determined that the alignment quality for the already-stacked sheets will be reduced, printing is interrupted to prevent reduction in the alignment quality, and if it is determined that the alignment quality for the already-stacked sheets will not be reduced, the discharge process can be continued without interrupting printing. As a result, the usability is improved.

In the third embodiment, when sheets having a smaller sheet width than sheets that are already stacked on a stack tray are to be stacked on the already-stacked sheets, the discharge process is continued without applying the alignment process to the sheets having the smaller sheet width if the number of the sheets having the smaller sheet width is smaller than or equal to the number of sheets allowed. Alternatively, similarly to the first embodiment described with reference to FIG. 13, the discharge process may be continued depending on whether or not the sheet width of the next page is the same as the sheet width of the sheet P, or may be continued after the sheets already stacked on the stack tray are removed.

Fourth Embodiment

The above third embodiment has described the example in which, if a sheet has a larger width than a preceding sheet, the alignment process is executed without interrupting printing. When the front surface of the already-stacked sheets is blank, that is to say, when an image is not printed on the front surface of the already-stacked sheets, the quality of the already-stacked sheets is not reduced even if the alignment plates slide against the front surface of the already-stacked sheets. In view of this, the fourth embodiment describes the example in which, when a sheet P has a smaller sheet width than preceding sheets, the alignment process is executed without interrupting printing if the front surface of the topmost sheet of the already-stacked sheets is blank. Note that a configuration of an image forming system according to the present fourth embodiment is the same as the configurations of the image forming systems according to the first to third embodiments described above, and therefore a description thereof is omitted. In the present fourth embodiment, only features that are different from the above third embodiment are described, and constituent elements having the same configurations as those in the above third embodiment are described using the same reference numbers thereas.

Figure 19A:
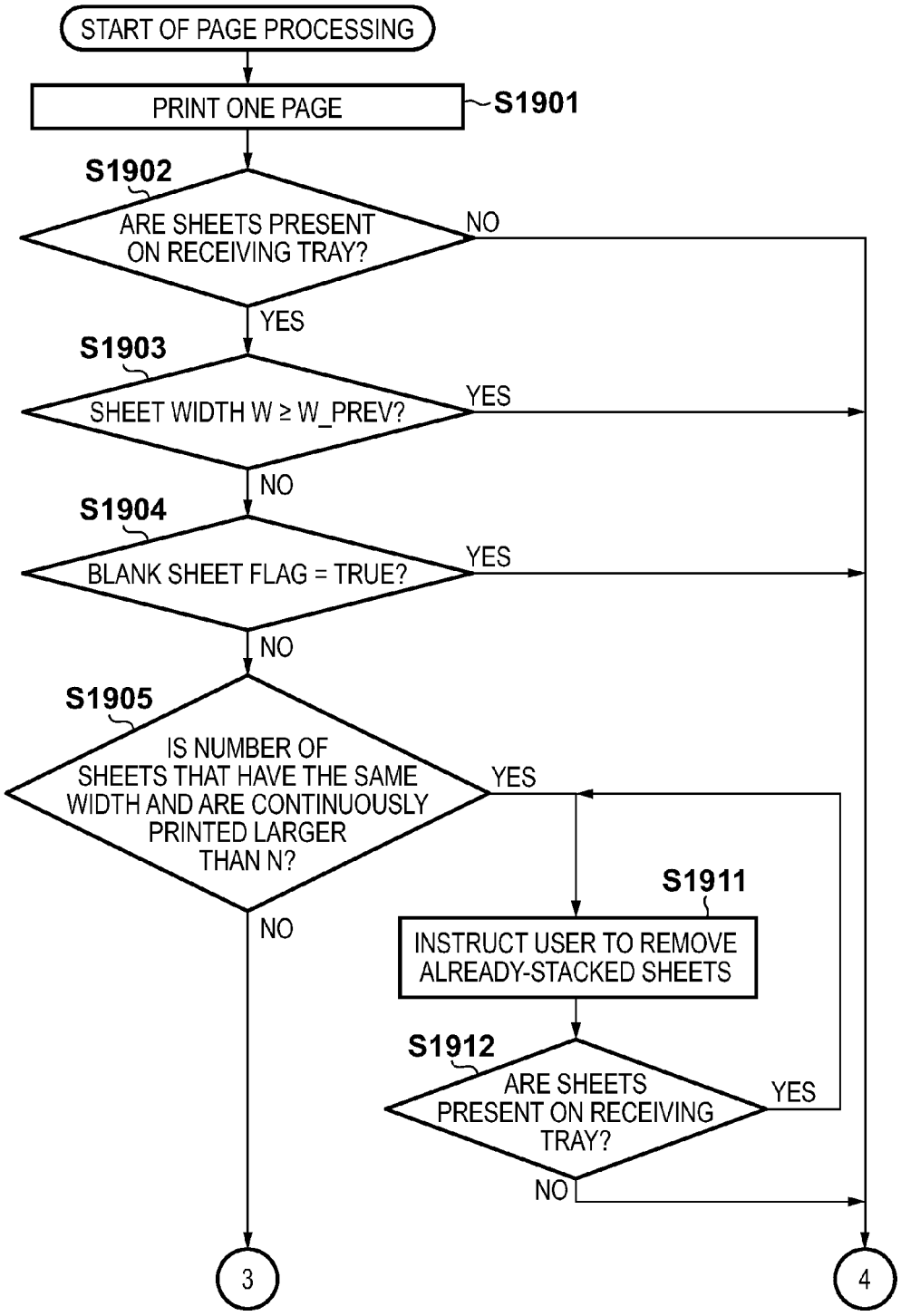
FIG. 19A and FIG. 19B are flowcharts for describing processing in which an image forming apparatus according to some embodiments prints a sheet and discharges the printed sheet to a finisher.
Figure 19B:
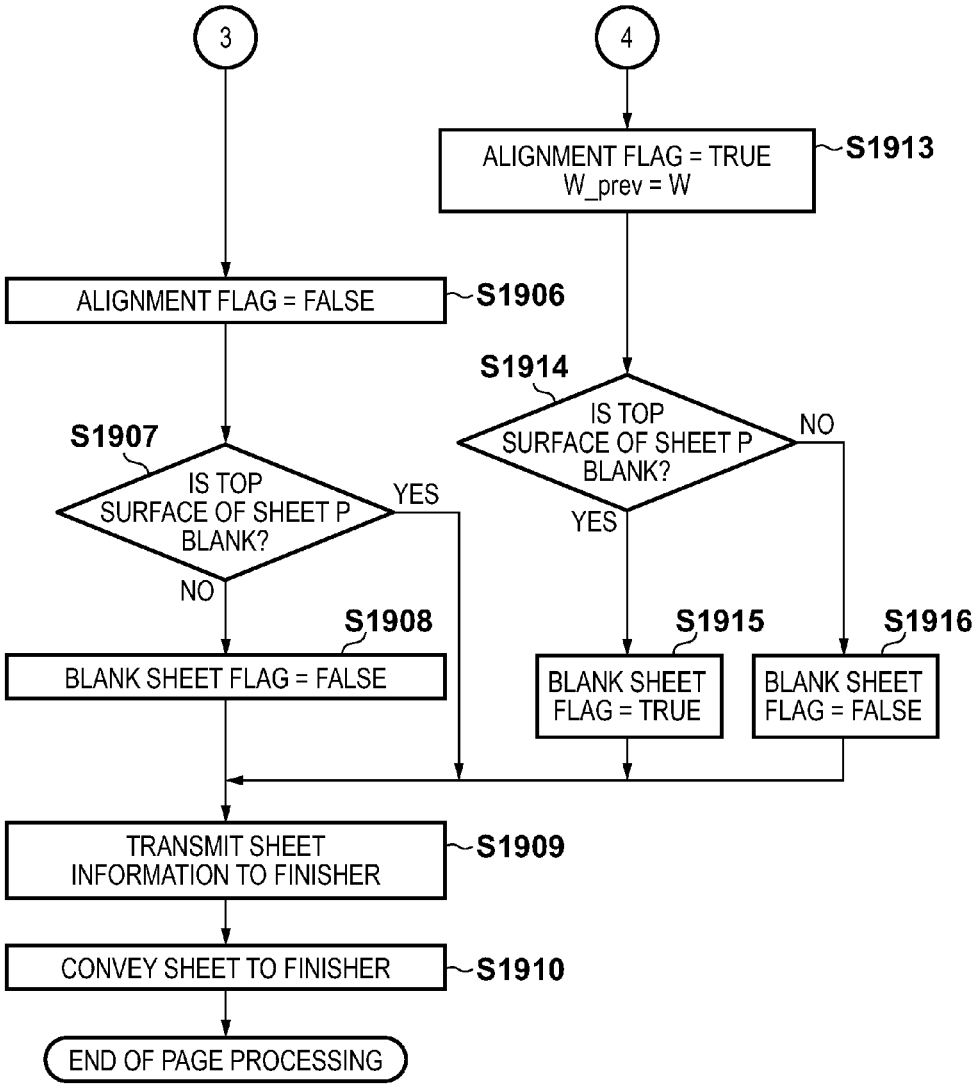
Figure 20:
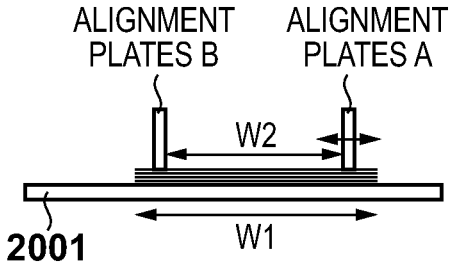
FIG. 20 is a diagram for describing alignment operations executed when a plurality of sheets having different sheet widths are stacked.

A description is now given of page printing operations executed by the CPU 901 in the CPU circuit unit 900 in the controller according to the present fourth embodiment with reference to flowcharts of FIGS. 19A and 19B.

FIGS. 19A and 19B are flowcharts for describing processing in which the image forming apparatus 10 according to the present fourth embodiment prints a sheet and discharges the printed sheet onto a finisher. A program for executing this processing is stored in the ROM 902. This processing is realized by the CPU 901 executing the stored program. In this flowcharts of FIGS. 19A and 19B, the processes of steps S1901 to S1903 are the same as the processes of steps S1801 to S1803 in the flowchart of FIG. 18, and therefore a description thereof is omitted.

In step S1904, the CPU 901 determines whether or not the front surface of a preceding sheet is blank by referring to a variable blank sheet flag that indicates whether or not the front surface of a preceding sheet is blank. If the CPU 901 determines that the top surface of the preceding sheet is blank, the CPU 901 proceeds to step S1913 and sets the alignment process to be executed. If the CPU 901 determines otherwise, the CPU 901 proceeds to step S1905. In step S1903, the CPU 901 sets the alignment flag to "TRUE" and sets the width of the current sheet to W_prev. Then, in step S1914, the CPU 901 determines whether or not the front surface of the current sheet P is blank. If the front surface of the current sheet P is blank, the CPU 901 proceeds to step S1915, sets the blank sheet flag to "TRUE", and proceeds to step S1909. If the front surface of the current sheet P is not blank, the CPU 901 proceeds to step S1916, sets the blank sheet flag to "FALSE", and proceeds to step S1909. In the flowcharts of FIGS. 19A and 19B, the processes of steps S1905 and S1906 are the same as the processes of steps S1804 and S1805 in the flowchart of FIG. 18, and therefore a description thereof is omitted.

In step S1907, the CPU 901 determines whether or not the top surface of the sheet P is blank. If an image is not printed on the top surface of the sheet P, the CPU 901 determines that the top surface of the sheet P is blank and proceeds to step S1909. If an image is printed on the top surface of the sheet P, the CPU 901 proceeds to step S1908. The CPU 901 sets the blank sheet flag to "FALSE" in step S1908, then proceeds to step S1909. In the flowcharts of FIGS. 19A and 19B, the processes of steps S1909 to S1913 are the same as the processes of steps S1806 to S1810 in the flowchart of FIG. 18, and therefore a description thereof is omitted.

According to the above-described fourth embodiment, when sheets having a smaller sheet width than sheets that are already stacked on a stack tray are to be stacked directly on the already-stacked sheets, the alignment process is executed without interrupting printing if the top surface of a preceding sheet is blank. On the other hand, if the top surface of the preceding sheet is not blank and the number of sheets that have a smaller width than the preceding sheet and are to be continuously printed does not exceed a predetermined number, the alignment process is not applied to those sheets. If the top surface of the preceding sheet is not blank and the number of sheets that have a smaller width than the preceding sheet and are to be continuously printed exceeds the predetermined number, the print process is interrupted and a message for guiding the user to remove the already-stacked sheets is displayed to the user. Furthermore, when sheets that have the same sheet width as or a larger sheet width than sheets that are already stacked on a stack tray are to be stacked directly on the already-stacked sheets, the alignment process is executed without interrupting printing.

In this way, if it is determined that the alignment quality for the already-stacked sheets will be reduced, printing is interrupted to prevent reduction in the alignment quality, and if it is determined that the alignment quality for the already-stacked sheets will not be reduced, the discharge process can be continued without interrupting printing. As a result, the usability is improved.

In the fourth embodiment, when sheets having a smaller sheet width than sheets that are already stacked on a stack tray are to be stacked on the already-stacked tray and the preceding sheet is not a blank sheet, the discharge process is continued without applying the alignment process to the sheets having the smaller sheet width if the number of the sheets having the smaller sheet width is smaller than or equal to the number of sheets allowed. Alternatively, similarly to the first embodiment described with reference to FIG. 13, the discharge process may be continued depending on whether or not the sheet width of the next page is the same as the sheet width of the sheet P, or may be continued after the sheets already stacked on the stack tray are removed.

One of the printing operations according to the first to fourth embodiments described above may be selected by the user.

Other Embodiments

In the examples described in the above embodiments, an image is printed in steps S1301, S1701, S1801 and

S1901. However, the present invention is not limited in this way. Alternatively, an image may be printed in steps S1307, S1707, S1807 and S1910, but not in steps S1301, S1701, S1801 and S1901. In this way, a sheet on which an image has been printed need not be stopped on the conveyance path while guidance to remove the already-stacked sheets is being displayed in steps S1306, S1706, S1806 and S1911.

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-247748, filed Nov. 9, 2012, which is hereby incorporated by reference herein in its entirety.

What is claimed is:

1. A sheet processing apparatus comprising:

a stacking unit configured to stack a discharged sheet;

an alignment unit configured to align sheets stacked on the stacking unit by causing a first alignment member and a second alignment member to come into contact with edges of the sheets stacked on the stacking unit;

a determination unit configured to, in a case where a second sheet which has a width that is different from a width of a first sheet stacked on the stacking unit is to be stacked on the first sheet, determine whether or not the alignment unit is to apply an alignment process to the second sheet; and a controller configured to in a case where the determination unit determines that the alignment process is not to be applied to the second sheet, perform control to stack the second sheet on the stacking unit and control the alignment unit not to apply the alignment process to the second sheet, and in a case where the determination unit determines that the alignment process is to he applied to the second sheet, perform control to stack the second sheet on the stacking unit and cause the alignment unit to apply the alignment process to the second sheet.

2. The sheet processing apparatus according to claim 1, further comprising:

an instruction unit configured to instruct a user to remove the first sheet stacked on the stacking unit in a case where:

the second sheet has a smaller width than the first sheet and another sheet follow the second sheet;

the second sheet has a smaller width than the first sheet and a number of other sheets following the second sheet is larger than a predetermined number; or the second sheet has a smaller width than the first sheet, a front surface of the first sheet is not blank, and the number of the other sheets following the second sheet is larger than the predetermined number, and wherein, after the first sheet are removed from. the stacking unit in accordance with the instruction from the instruction unit, the controller performs control to stack the second sheet on the stacking unit and cause the alignment unit to apply the alignment process to the second sheet.

3. The sheet processing apparatus according to claim 2, further comprising:

a setting unit configured to set the predetermined number.

4. The sheet processing apparatus according to claim 1, wherein the determination unit determines that the alignment process is not to be executed in a case where the second sheet does not have same width as the first sheet and the second sheet is not followed by any other sheet that has same width as the second sheet.

5. The sheet processing apparatus according to claim 1, wherein the determination unit further determines that the alignment process is not to be executed in a case where a front surface of a topmost sheet of stacked first sheets is not blank and the second sheet does not have same width as the first sheet and the second sheet is not followed by any other sheet that has same width as the second sheet.

6. The sheet processing apparatus according to claim 1, wherein the determination unit determines that the alignment process is not to be executed in a case where the second sheet has a smaller width than the first sheet and number of other sheets following the second sheet is smaller than a predetermined number.

7. The sheet processing apparatus according to claim 1, wherein the determination unit determines that the alignment process is to be executed in a case where the second sheet has a larger width than the first sheet.

8. The sheet processing apparatus according to claim 1, wherein the determination unit determines that the alignment process is not to be executed in a case where the second sheet has a smaller width than the first sheet.

9. A control method for controlling a sheet processing apparatus that includes a stacking unit on which a discharged sheet is stacked and an alignment unit that aligns a sheet stacked on the stacking unit by causing a first alignment member and a second alignment member to come into contact with edges of the sheet stacked on the stacking unit, the method comprising:

determining, in a case where a second sheet which has a width that is different from a width of a first sheet stacked on the stacking unit is to be stacked on the first sheet, whether or not the alignment unit is to apply an alignment process to the second sheet; and in a case where it is determined that the alignment process is not to be applied to the second sheet, controlling to stack the second sheet on the stacking unit and controlling the alignment unit not to apply the alignment process to the second sheet, and in a case where it is determined that the alignment process is to be applied to the second sheet, controlling to stack the second sheet on the stacking unit and causing the alignment unit to apply the alignment process to the second sheet.

10. A computer-readable storage medium having stored therein a program for causing a computer to execute the steps so as to control a sheet processing apparatus that includes a stacking unit on which a discharged sheet is stacked and an alignment unit that aligns the sheet stacked on the stacking unit by causing a first alignment member and a second alignment member to come into contact with edges of the sheet stacked on the stacking unit:

determining, in a case where a second sheet which has a width that is different from a width of a first sheet stacked on the stacking unit is to be stacked on the first sheet, whether or not the alignment unit is to apply an alignment process to the second sheet; and in a case where it is determined that the alignment process is not to be applied to the second sheet, controlling to stack the second sheet on the stacking unit and controlling the alignment unit not to apply the alignment process to the second sheet, and in a case where it is determined that the alignment process is to be applied to the second sheet, controlling to stack the second sheet on the stacking unit and causing the alignment unit to apply the alignment process to the second sheet.

* * * * *